US006618043B2

(12) United States Patent
Washio et al.

(10) Patent No.: US 6,618,043 B2
(45) **Date of Patent: *Sep. 9, 2003**

(54) IMAGE DISPLAY DEVICE AND IMAGE DISPLAY METHOD

(75) Inventors: Hajime Washio, Tenri (JP); Yasushi Kubota, Sakurai (JP); Yasuyoshi Kaise, Tenri (JP); Tamotsu Sakai, Tenri (JP); Kazuhiro Maeda, Tenri (JP)

(73) Assignee: Sharp Kabushiki Kaisha (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/504,418

(22) Filed: Feb. 15, 2000

(65) Prior Publication Data

US 2002/0196240 A1 Dec. 26, 2002

(30) Foreign Application Priority Data

Feb. 16, 1999 (JP) ..... 11-036779
Sep. 21, 1999 (JP) ..... 11-266477

(51) Int. Cl.[7] ..... G09G 5/00; G09G 3/36

(52) U.S. Cl. ..... 345/204; 345/211; 345/87; 345/98

(58) Field of Search ..... 345/87, 92, 90, 345/93, 94, 89, 95, 100, 103, 211, 212, 213, 204

(56) References Cited

U.S. PATENT DOCUMENTS 5,952,861 A * 9/1999 Kim et al. ..... 327/227
5,959,600 A * 9/1999 Uchino et al. ..... 345/94
5,973,972 A * 10/1999 Kwon et al. ..... 365/203
6,122,218 A * 9/2000 Kang ..... 365/230.05
6,307,681 B1 * 10/2001 Aoki et al. ..... 345/94
6,313,819 B1 * 11/2001 Maekawa et al. ..... 345/92
6,333,881 B1 * 12/2001 Kusunoki et al. ..... 365/203

* cited by examiner

*Primary Examiner*—Steven Saras
*Assistant Examiner*—Alecia D. Nelson
(74) *Attorney, Agent, or Firm*—Edwards & Angell, LLP; John J. Penny, Jr.; David G. Conlin

(57) ABSTRACT

A precharge circuit is composed of (a) a reference signal input section, to which at least one precharge reference potential is inputted, (b) a control signal input section, to which at least one control signal is inputted, (c) a plurality of signal delay sections for sequentially delaying an output of the control signal input section, and (d) a reference signal switching section for switching, in accordance with outputs of the signal delay sections, between a state of outputting the precharge reference potential of the reference signal input section to each of the data signal lines and a state of non-outputting the same thereto. With this arrangement, the precharge control signal is sequentially delayed within the precharge circuit by the delay circuits composed of inverter circuits or the like, so that timings at which the precharge reference potential is written in the data signal lines are dispersed. By sequentially delaying the control signal within the precharge circuit, reduction of power consumption and excellent image display are realized.

30 Claims, 29 Drawing Sheets

IMAGE DISPLAY DEVICE AND IMAGE DISPLAY METHOD

FIELD OF THE INVENTION

The present invention relates to an image display device and an image display method, and particularly relates to an image display device driven with use of a precharge circuit that improves performance of write of image signals to data signal lines, and an image display method applied to the same.

BACKGROUND OF THE INVENTION

The following description will explain an active-matrix-type liquid crystal display device as an example of a conventional image display device. The image display device is, as shown in FIG. 23, composed of a pixel array ARY, a scanning signal line driving circuit (gate driver) GD, a data signal line driving circuit (data driver) SD, and a precharge circuit PC.

The pixel array ARY includes a plurality of scanning signal lines GL and data signal lines SL that cross each other, and each area defined by two adjacent scanning signal lines GL and two adjacent data signal lines SL has one pixel PIX, thereby causing a plurality of pixels PIX to be provided in a matrix form.

Each pixel PIX, as shown in FIG. 24, is composed of a switching element SW, a liquid crystal capacitor CL, and a supplemental capacitor CS. As shown in FIG. 25, in synchronization with timing signals such as a clock signal CKS and a data start signal SPS, the data signal line driving circuit SD samples image signals DAT inputted by an analog switch AS, then amplifies the sampled signals as required, and write the same into the data signal lines SL. In the FIG., N1 through N4 denote NAND circuits.

The scanning signal line driving circuit GD, as shown in FIG. 26, sequentially selects the scanning signal lines GL in synchronization with timing signals such as the clock signal CKG and the scanning start signal SPG, writes the image signals DAT written in the data signal lines SL into the pixels PIX by opening/closing the switching elements SW in the pixels PIX, and retains the written image signals DAT with use of the capacitors in the pixels. In FIGS. 25 and 26, SRs are shift resistors that sequentially output signals inputted thereto, in synchronization with a clock signal which is separately supplied thereto.

The precharge circuit PC samples a precharge reference potential PCV inputted thereto in synchronization with a precharge control signal (precharge control signal) PCC serving as a timing signal, and writes a signal of the precharge reference potential into the data signal lines before the image signals DAT are written therein.

By repeatedly carrying out the foregoing operations, an image is displayed on the pixel array ARY. A timing chart of these signals is shown in FIG. 27.

In FIG. 27, the image signals DAT are inputted in synchronization with the clock signals CKS and /CKS and the data start signal SPS of the data signal line driving circuit. As a driving method of a horizontal line inversion type is adopted in this case, image signals with a negative polarity are written in lines corresponding to scanning signal lines $GL_j$, while image signals with a positive polarity are written in lines corresponding to scanning signal lines $GL_{j+1}$. During a flyback period (a period in which image signals are not inputted), the precharge control signal PCC is activated, and the data signal lines are precharged to have a precharge reference potential each. Here, the polarity of the precharge reference potential PCV is the same as that of the image signal DAT to be written next.

Recently, as the image display devices come to have further higher definition, the sampling rate of a data signal line driving circuit SD is increased. On the other hand, this entails a drawback in that write of image signals DAT into data signal lines becomes insufficient, thereby deteriorating quality of images. Then, adopted to cope with this drawback is a scheme in which data signal lines SL are precharged by means of a precharge circuit PC to a precharge reference potential (PCV), before image signals DAT are written into the data signal lines SL, so that deterioration of image quality is prevented.

FIG. 28 shows a concrete example of an arrangement of the precharge circuit. A precharge circuit 201 is provided with a reference signal input section 202 and a reference signal switching section 203. The reference signal switching section 203 is provided with a switching element PAS group. More specifically, as shown in the figure, each data signal line SL is connected with one sampling-use switching element PAS, and each switching element is connected with the reference signal input section 202 so that the precharge reference potential PCV and the precharge control signal PCC are inputted to each switching element. The precharge circuit is intended to charge the data signal lines to the precharge reference potential PCV each at timings according to the precharge control signal PCC.

As shown in FIG. 28, however, the same number of switching elements PAS as that of data signal lines SL are connected with a line for supplying the precharge reference potential. To charge the data signal lines SL to the precharge reference potential within a small time as shown in the timing chart of FIG. 27, relatively great power is required. Therefore, a high-power element is used as the switching element PAS. Further, in the case where the switching element PAS group is controlled simultaneously for a precharging operation, a great quantity of charges move to the data signal lines SL, causing fluctuation of the precharge reference potential PCV.

If the potential having fluctuated is not stabilized to an appropriate level by the time when the sampling of the precharge reference potential is finished, this results in that the data signal lines SL are not charged to a sufficient level. This likely adversely affects the potential of the image data DAT written by the data signal line driving circuit SD to the data signal lines SL, thereby causing degradation of display.

Furthermore, if a quantity of current supplied from outside for producing the precharge reference potential is increased to suppress the fluctuation of the precharge reference potential (a driving force of the circuit for producing the precharge reference potential is increased), there arises another drawback in that power consumption increases.

Moreover, recently, decrease in an amplitude of an input signal supplied to a liquid crystal display device has been increasingly demanded. Conventionally, as shown in FIG. 29, a signal supplied from outside is fed to a circuit after an amplitude of the signal is increased by a level shifter such as a signal amplitude amplifying section 204. Here, since the line for supplying the precharge control signal runs along one side of the liquid crystal display device and a great load is applied thereto, it is necessary to provide an extremely high-power buffer circuit 205 behind the level shifter. Such a high-power buffer circuit, disadvantageously, may tend to drastically increase power consumption while deteriorates reliability of the driving circuit.

SUMMARY OF THE INVENTION

An object of the present invention is to provide an image display device and an image display method using a precharge circuit capable of suppressing fluctuation of a reference signal potential that is written into data signal lines to precharge the data signal lines while not augmenting power consumption.

To achieve the foregoing object, an image display device of the present invention, having a plurality of pixels in matrix that are defined by a plurality of data signal lines arranged in a row direction and a plurality of scanning signal lines arranged in a column direction, a data signal line driving circuit for feeding image signals to the data signal lines, and a scanning signal line driving circuit for feeding a scanning signal to the scanning signal lines, is characterized by comprising (i) a reference signal input section, to which at least one precharge reference potential is inputted, (ii) a control signal input section, to which at least one control signal is inputted, (iii) a plurality of signal delay sections for sequentially delaying an output of the control signal input section, and (iv) a reference signal switching section for switching, in accordance with outputs of the signal delay sections, between a state of outputting the precharge reference potential of the reference signal input section to each of the data signal lines and a state of non-outputting the same thereto.

As described above, the image display device of the present invention is designed so as to include a precharge circuit composed of (i) a reference signal input section, to which at least one precharge reference potential is inputted, (ii) a control signal input section, to which at least one precharge control signal is inputted, (iii) a plurality of signal delay sections (hereinafter referred to as delay circuits) for sequentially delaying an output of the control signal input section, and (iv) a reference signal switching section for opening/closing active elements for sampling use in accordance with outputs of the signal delay sections, so as to write the precharge reference potential into each of the data signal lines as required. This enables control of the switching elements according to the precharge control signal delayed sequentially by the delay circuits, thereby causing times when charges are transferred to the data signal lines from portions having the precharge reference potential to be dispersed. Therefore, transfer of a great quantity of charges at once is prevented. As a result, fluctuation of the precharge reference potential is suppressed, and data signal lines are charged to desirable potential levels. Consequently, this ensures that deterioration of image quality is avoided, that a quantity of electric current for the precharge reference potential that is supplied from outside is decreased, and that an increase in power consumption is effectively suppressed.

Furthermore, to achieve the aforementioned object, an image display method of the present invention, for displaying an image on an image display device with a plurality of pixels in matrix that are defined by a plurality of data signal lines arranged in a row direction, to which image signals are fed, and by a plurality of scanning signal lines arranged in a column direction, to which a scanning signal is fed, which method has the step of writing the image signals to the data signal lines after writing a precharge reference potential from a precharge circuit into each of the data signal lines, is characterized in that timings of write of the precharge reference potential fed from the precharge circuit into the data signal lines are varied so that at least two timings are available.

For a fuller understanding of the nature and advantages of the invention, reference should be made to the ensuing detailed description taken in conjunction with the accompanying drawings.

DESCRIPTION OF THE PREFERRED EMBODIMENTS

[First Embodiment]

Figure 1:
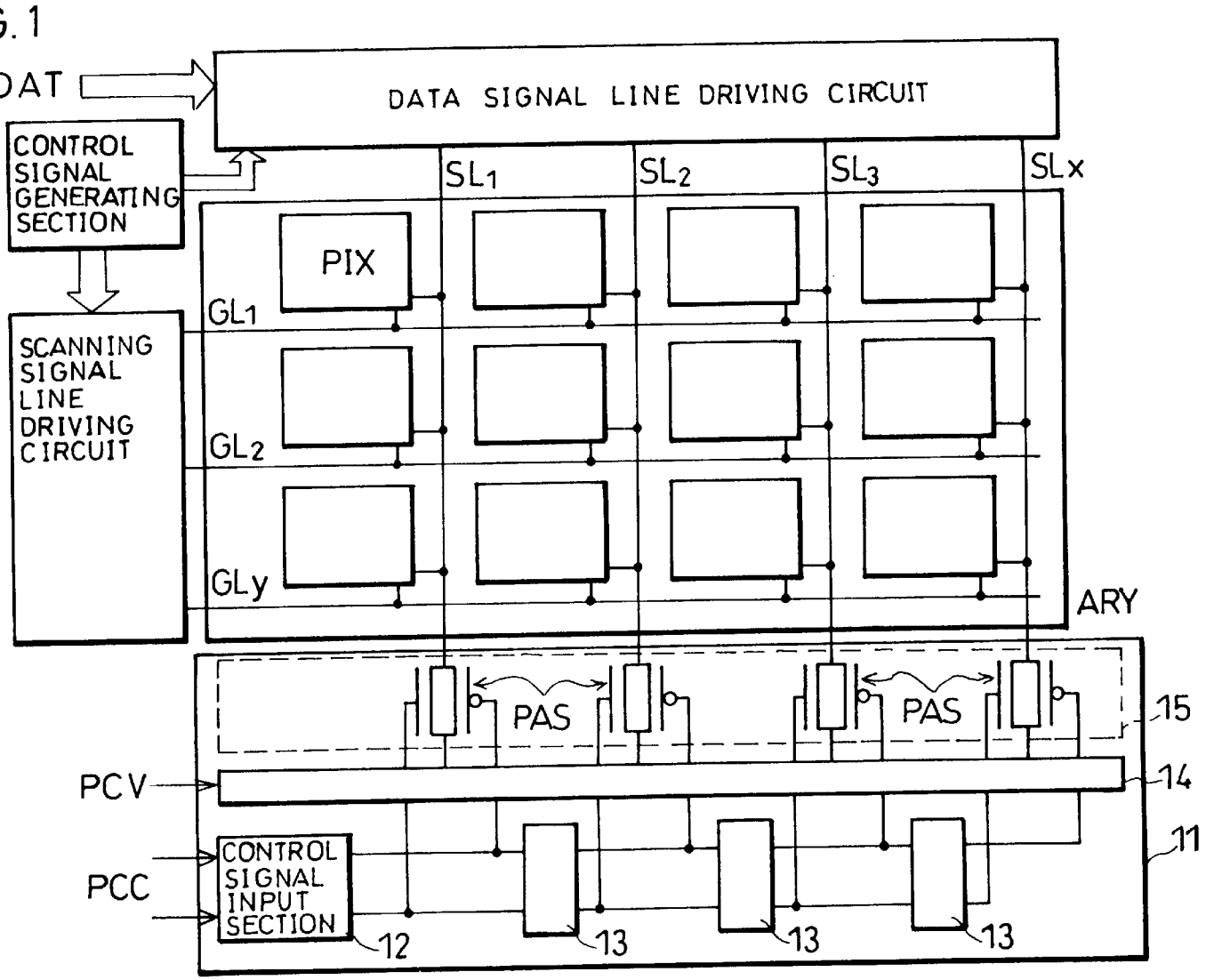
FIG. 1 is a block diagram illustrating an arrangement of an image display device in accordance with the present invention.

The following description will explain an embodiment of the present invention while referring drawings. FIG. 1 is a block diagram illustrating an arrangement of an image display device in accordance with the present invention. The figure shows only pixels PIX defined by four data signal lines SL and three scanning signal lines GL, and omits the rest. In practical application, a plurality of data signal lines and a plurality of scanning signal lines may be formed between the data signal lines $SL_3$ and $LS_x$ and between the scanning signal lines $GL_2$ and $GL_y$, respectively, in the same manner as the data signal line $SL_3$ and the scanning signal line $GL_2$ are formed, so that pixels are provided therein. This applies to other arrangements shown in other figures.

In FIG. 1, the precharge circuit 11 is composed of a control signal input section 12, a plurality of delay circuits 13 provided for delaying a precharge control signal, a reference signal (precharge reference potential) input section 14, and a reference signal switching section 15 for switching between a state of output of the precharge reference potential to each data signal line and a state of non-output of the same. Incidentally, though one delay circuit 13 is provided to every data signal line in the foregoing case, one delay circuit may be provided with respect to a plurality of data signal lines. The number of data signal lines corresponding to one delay circuit may vary.

The precharge control signal PCC supplied to the control signal input section 12 drives the reference signal switching section (analog switch) 15, thereby causing the precharge reference potential PCV to be written in the data signal line SL at the first stage (and the vicinity of the same). At the same time, the precharge control signal PCC is delayed by the delay circuits 13 sequentially, thereby causing the precharge reference potential PCV to be also written into the data signal lines SL at the subsequent stages. This causes peaks of current as the precharge control signal PCC and the precharge reference potential PCV to be dispersed.

Figure 2:
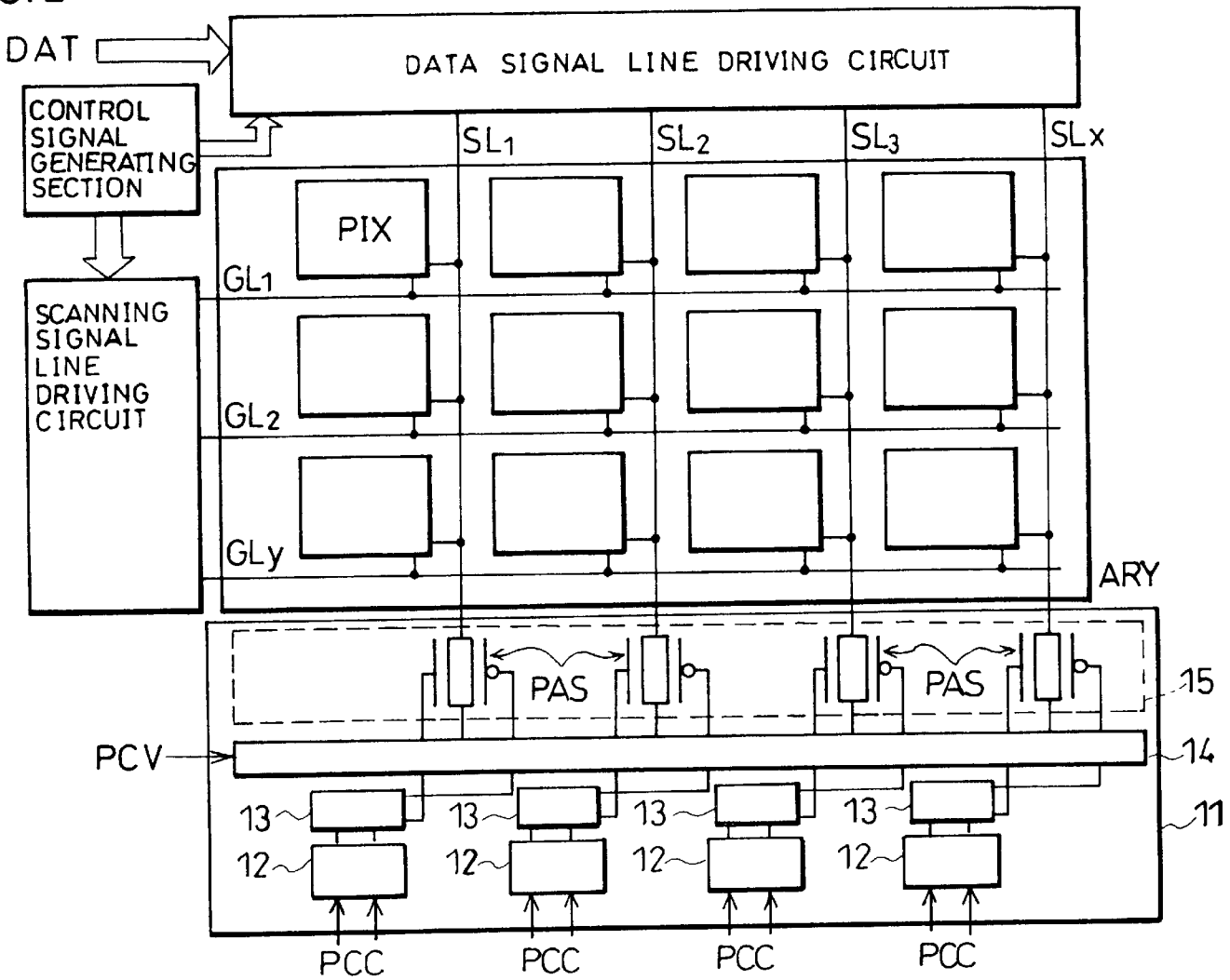
FIG. 2 is a block diagram illustrating another arrangement of an image display device in accordance with the present invention.
Figure 3:
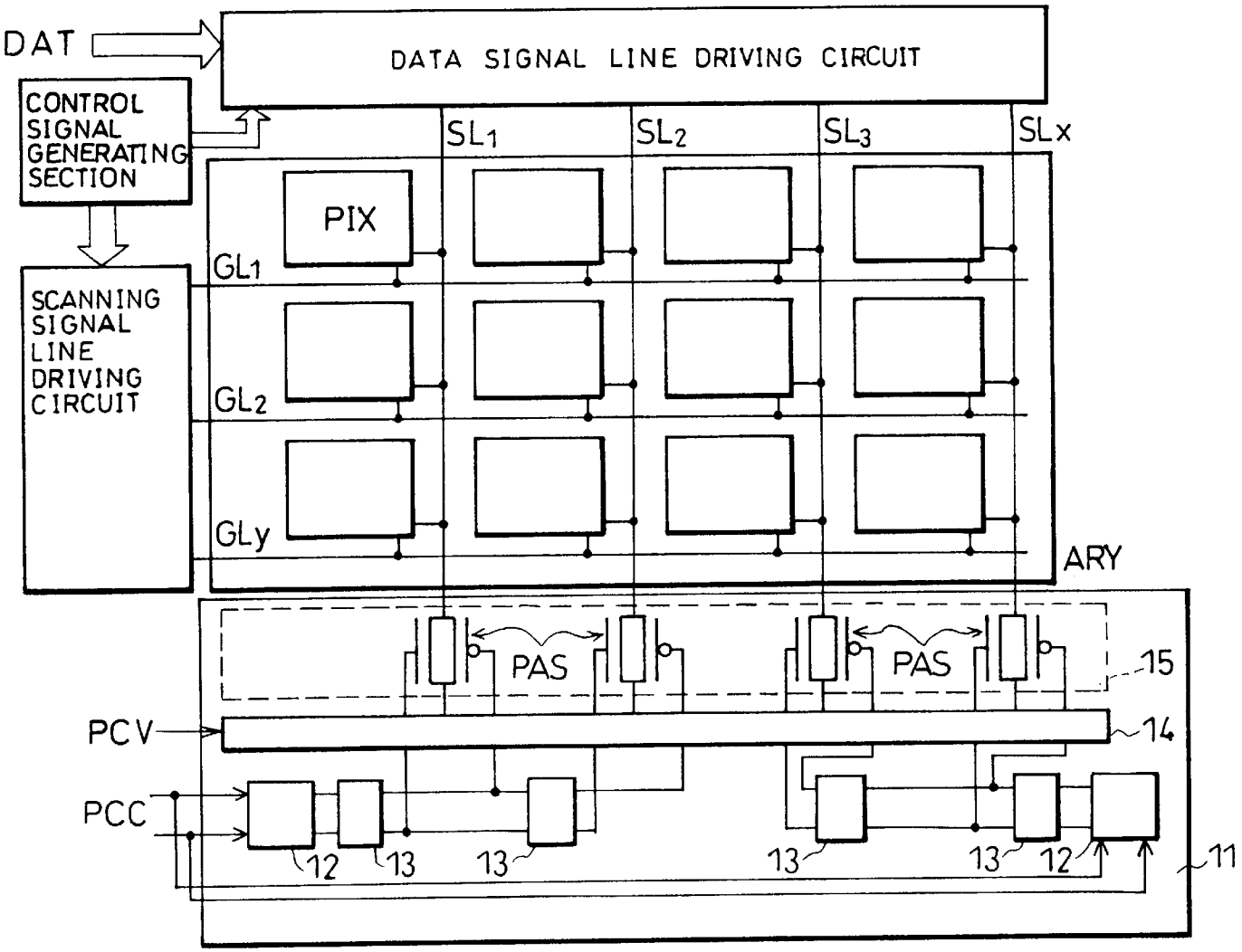
FIG. 3 is a block diagram illustrating still another arrangement of an image display device in accordance with the present invention.
Figure 4:
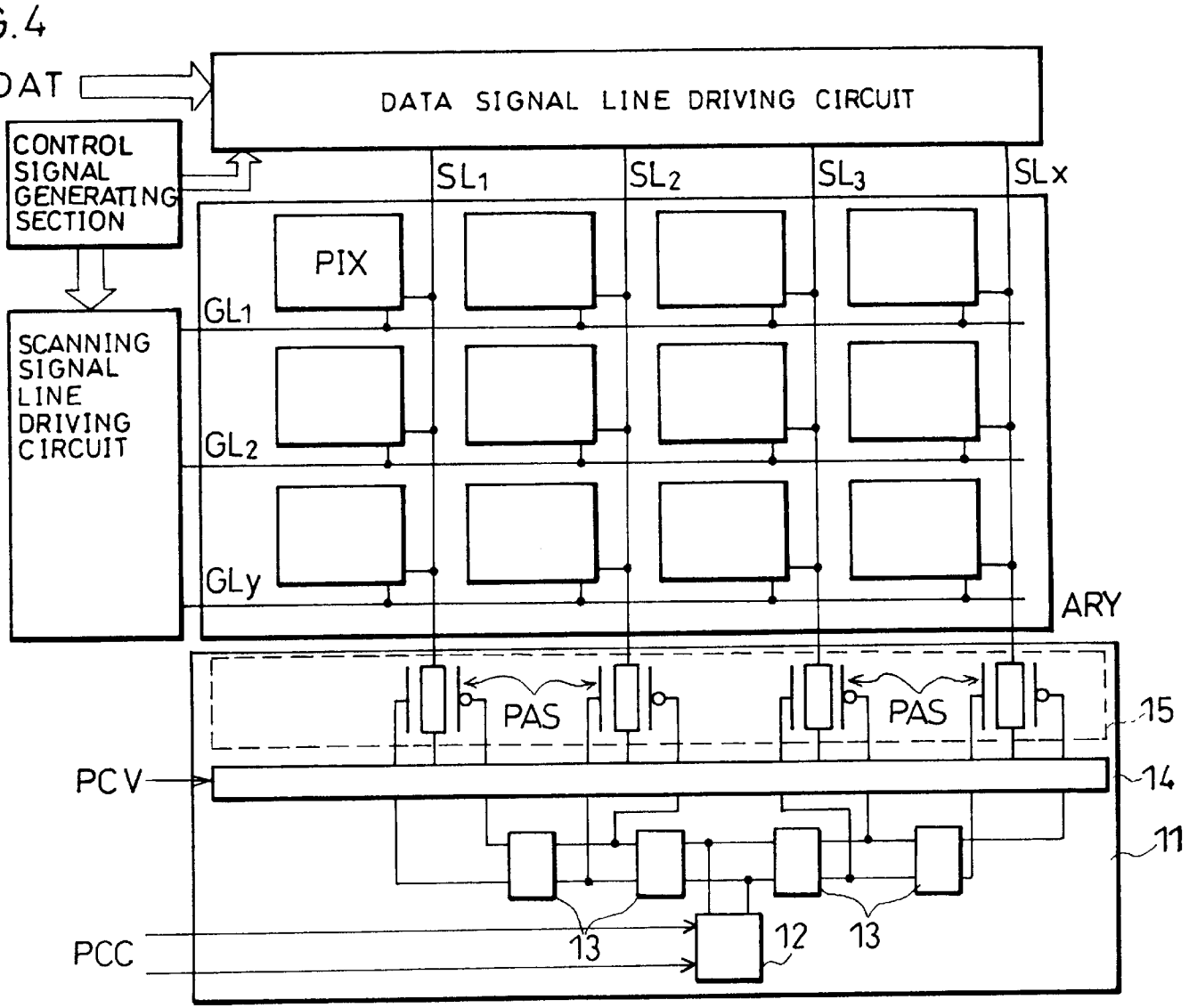
FIG. 4 is a block diagram illustrating still another arrangement of an image display device in accordance with the present invention.

FIGS. 2 through 4 are block diagrams illustrating another arrangement of the image display device in accordance with the present invention. As shown in FIG. 2, a plurality of control signal input sections 12 are provided, each of which is supplied with the precharge control signal. In FIG. 3, the control signal input sections 12 are provided at both the ends of the precharge circuit 11, respectively, through which the precharge control signal is fed to the delay circuits 13. In FIG. 4, the control signal input section 12 is provided around the center of the precharge circuit 11, through which the precharge control signal is fed to the delay circuits 13. According to these arrangements, the precharge control signal is fed to the delay circuits 13 through the control signal input sections 12 disposed at a plurality of positions, at both ends, or around center of the precharge circuit 11. Therefore, delay of the precharge control signal can be easily optimized depending on each of several units of the delay circuits 13. Besides, in the case where the flyback period is short, the optimization of delay of the precharge control signal advantageously enables sufficient precharge of all the data signal lines within the flyback period.

Figure 5:
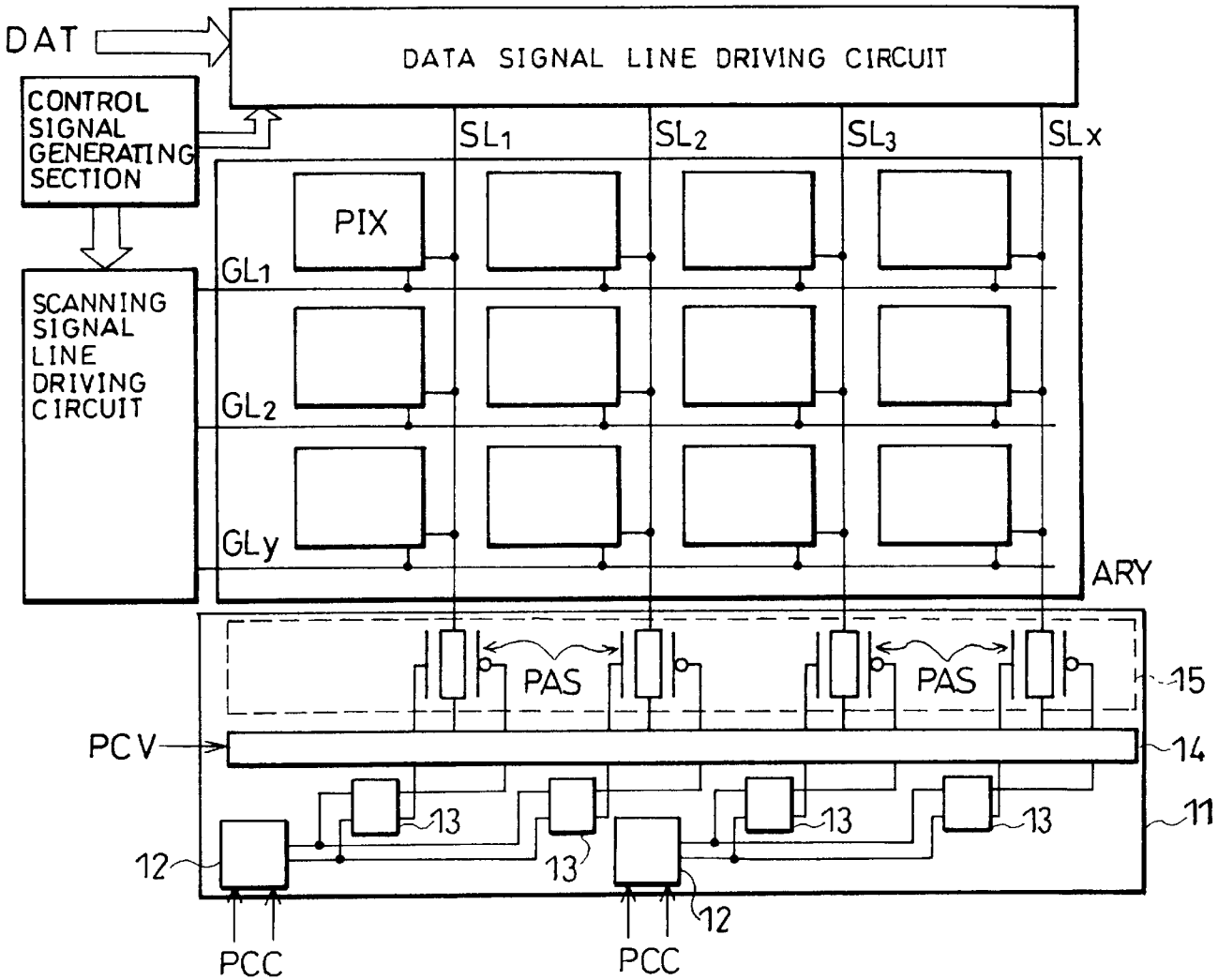
FIG. 5 is a block diagram illustrating still another arrangement of an image display device in accordance with the present invention.

FIG. 5 is a block diagram illustrating another arrangement of an image display device in accordance with the present invention. In the arrangement shown in FIG. 5, a plurality of delay circuits 13 are connected with each of a plurality of control signal input sections 12. With this arrangement, since the precharge control signal is fed to the delay circuits 13 in parallel from the control signal input section 12, optimization of delay of the precharge control signal depending on each of units of the delay circuits 13 is facilitated. Besides, in the case where the flyback period is short, the optimization of delay of the precharge control signal advantageously enables sufficient precharge of all the data signal lines within the flyback period.

Figure 6:
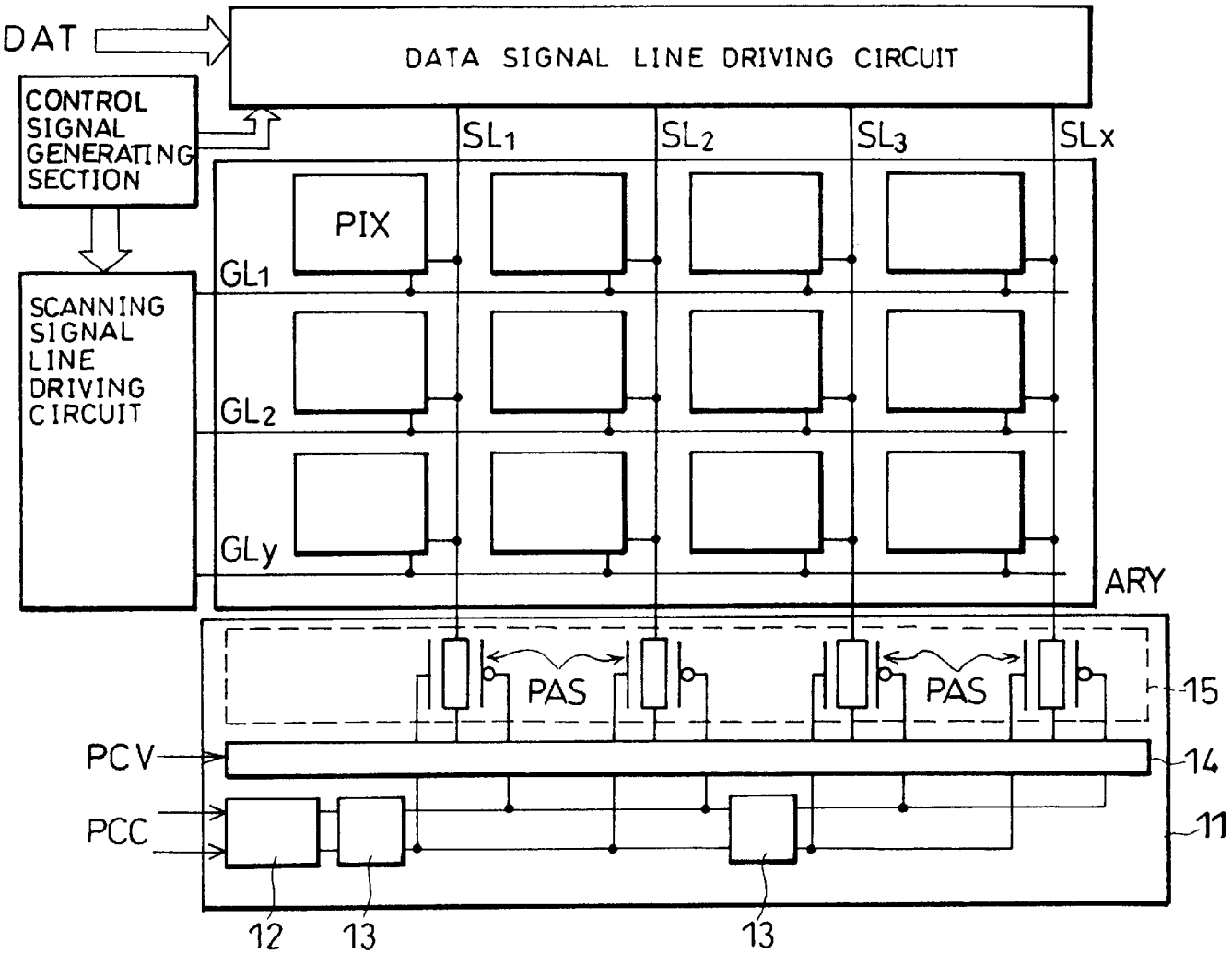
FIG. 6 is a block diagram illustrating still another arrangement of an image display device in accordance with the present invention.

FIG. 6 is a block diagram illustrating another arrangement of an image display device in accordance with the present invention. In the arrangement shown in FIG. 6, a plurality of the switching elements PAS composing the reference signal switching section 15 are connected with each delay circuit 13. With this arrangement, since the number of the delay circuits 13 does not excessively increase, delay of the precharge control signal can be advantageously optimized without making the arrangement of the precharge circuit 11 complicated.

Figure 7:
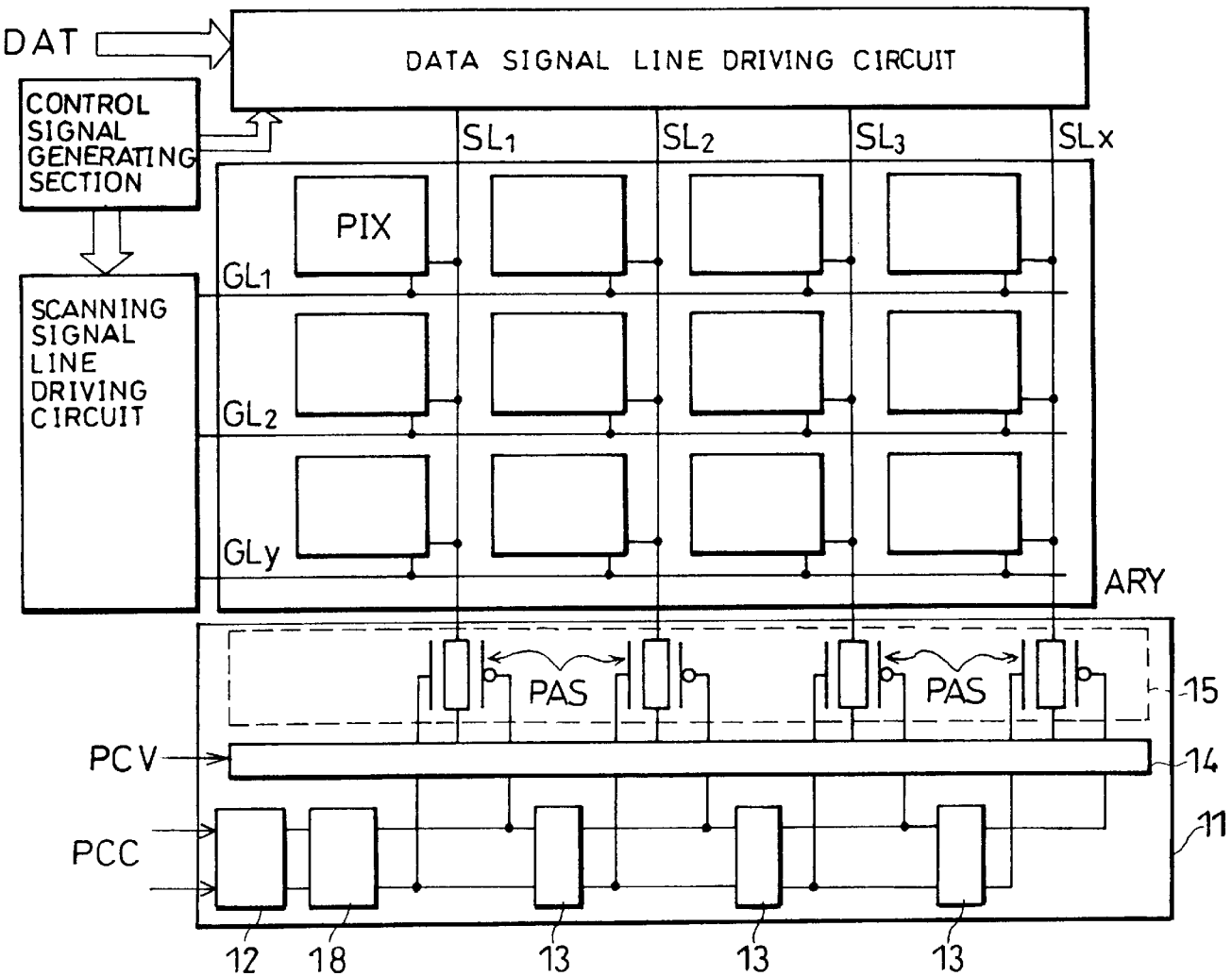
FIG. 7 is a block diagram illustrating still another arrangement of an image display device in accordance with the present invention.

FIG. 7 is a block diagram illustrating another arrangement of the image display device in accordance with the present invention. The arrangement shown in FIG. 7 is the arrangement shown in FIG. 1 modified so that a signal amplitude amplifying section 18 is provided on a precharge control signal PCC input side. With this arrangement, in the case where the precharge control signal PCC fed from outside has an amplitude smaller than that of a driving voltage of the reference signal switching section 15, normal actuation of the precharge circuit 11 can be realized. Incidentally, this arrangement can be applied to the arrangements shown in FIGS. 2 through 6.

[Second Embodiment]

Figure 8:
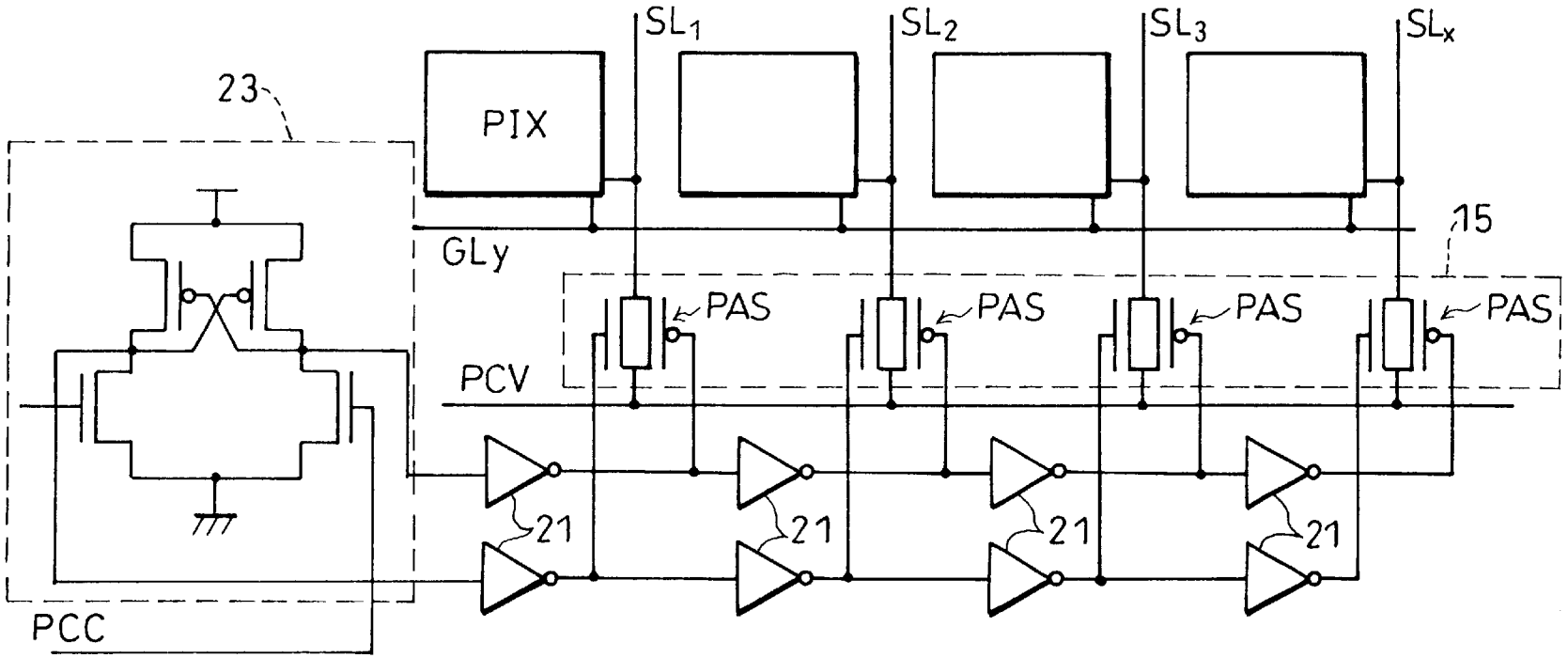
FIG. 8 is a circuit diagram illustrating an arrangement of delay circuits in a precharge circuit in accordance with the present invention.
Figure 9:
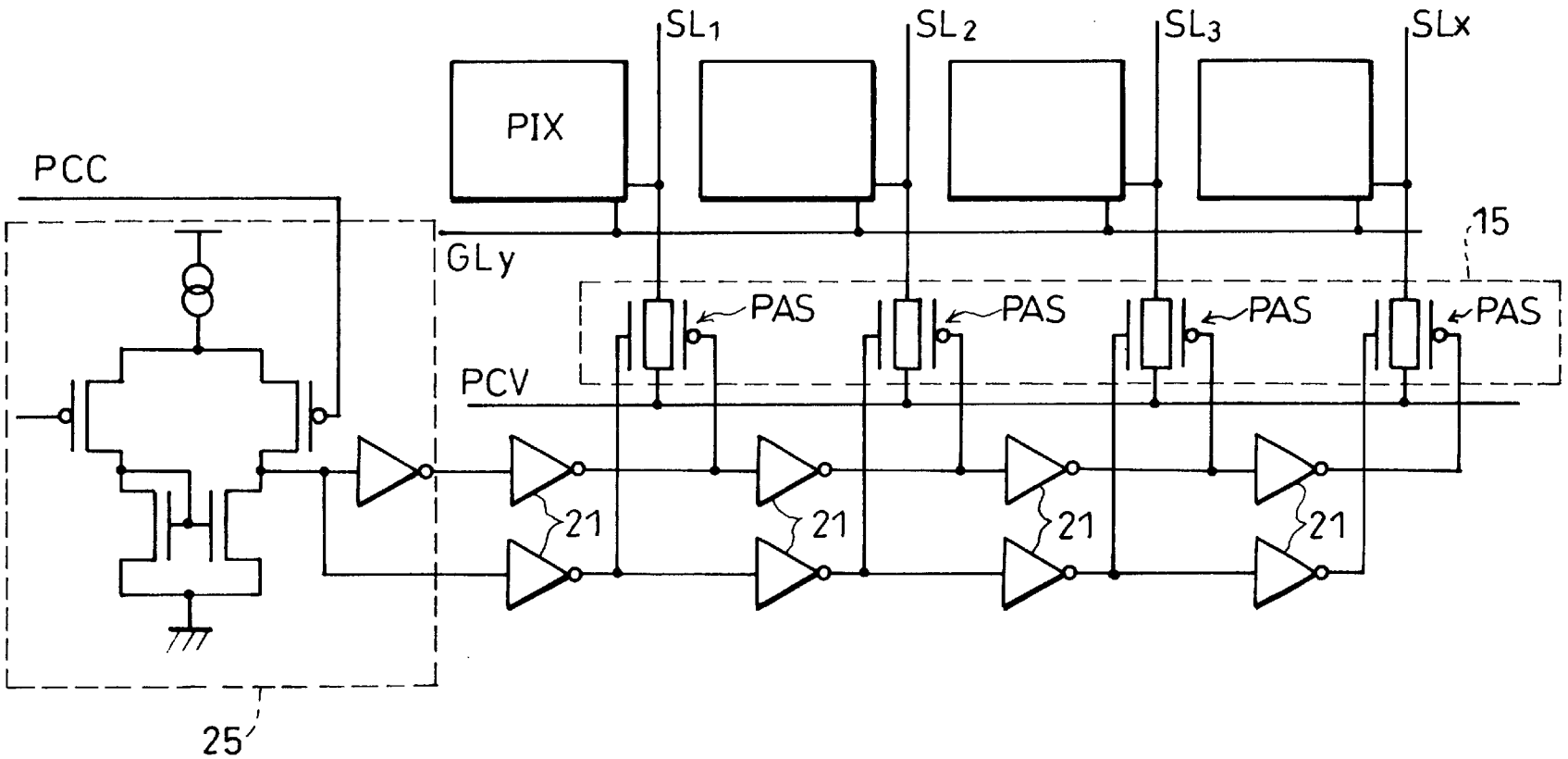
FIG. 9 is a circuit diagram illustrating another arrangement of delay circuits in a precharge circuit in accordance with the present invention.

The following description will explain another embodiment of a delay circuit applied in a precharge circuit in an image display device of the present invention. FIGS. 8 and 9 are views illustrating another arrangements of the delay circuits in the precharge circuit of the present invention. In the arrangements shown in FIGS. 8 and 9, a delay circuit is composed of inverter circuits 21. A signal amplitude amplifying section is a usual level shifter circuit 23 in the arrangement shown in FIG. 8, while a usual operational amplifier circuit 25 in the arrangement shown in FIG. 9. The signal amplitude amplifying section of the present invention may have any one of the arrangements, and it is desirable to select an optimal arrangement, with performance of transistors constituting the arrangement, input and output amplitudes, etc. taken into consideration.

Furthermore, the outputs of the delay circuit 13 are supplied to a CMOS analog switch PAS of the reference signal switching section 15, while the inverter circuit 21 at one stage in the delay circuit 13 is connected with another inverter circuit 21 at the next stage so that an n-channel transistor in one stage and a p-channel transistor in the other stage are connected with each other. This arrangement makes the delay circuit 13 function not only simply as a delay circuit but also as a buffer for increasing the driving force (reshaping the waveform), thereby suppressing dullness of the waveform of the precharge control signal, and ensuring accurate control of the analog switch PAS of the reference signal switching section 15 without malfunction of the same. Incidentally, this buffer circuit need not be composed of an inverter circuit of one stage, but may be composed of a plurality of inverter circuits.

Conventionally, the precharge control signal, immediately after being inputted, is amplified with use of one buffer circuit (signal amplitude amplifying section), whereas in the present embodiment the signal is amplified with use of a plurality of buffer circuits dispersedly arranged. Such an arrangement in which the buffer circuits are dispersedly provided enables reduction of a total area that the buffer circuits occupy, as compared with the arrangement in which a powerful buffer circuit is disposed at one place, thereby ensuring advantages in the occupied space and the yield.

Figure 10:
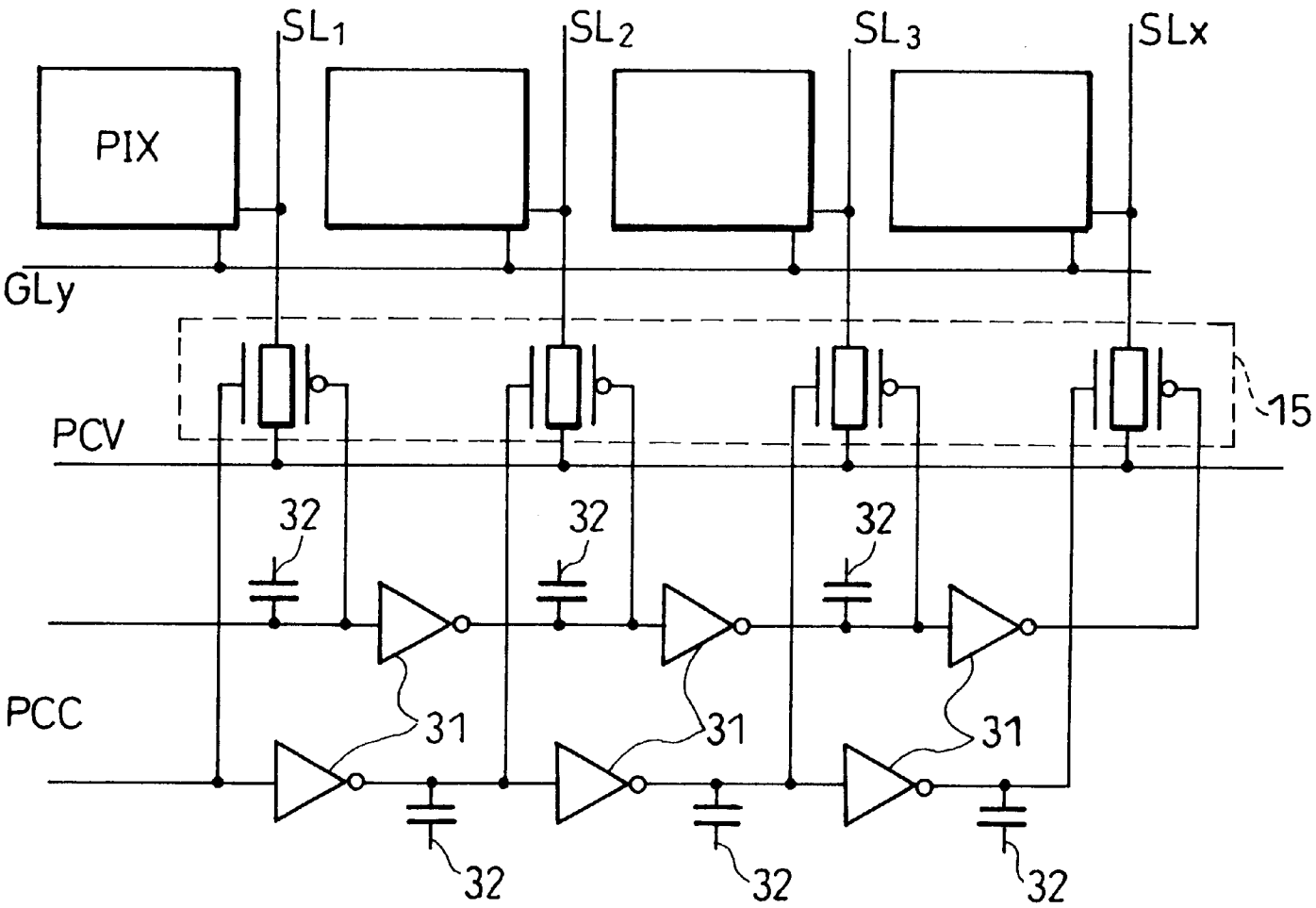
FIG. 10 is a circuit diagram illustrating still another arrangement of delay circuits in a precharge circuit in accordance with the present invention.

FIG. 10 is a view illustrating still another arrangement of the delay circuits 13 of the precharge circuit of the present invention. In the arrangement shown in FIG. 10, the delay circuit 13 for delaying the precharge control signal PCC is composed of an additional capacitor or wire capacitor 32 and an inverter circuit 31. A driving force and an input load are determined by appropriately varying a capacitance of the additional capacitor or wire capacitor 32 and a size of the inverter circuit 31, that is, channel lengths and widths of transistors composing the inverter circuit 31. As a result, an optimal delay is set.

Figure 11:
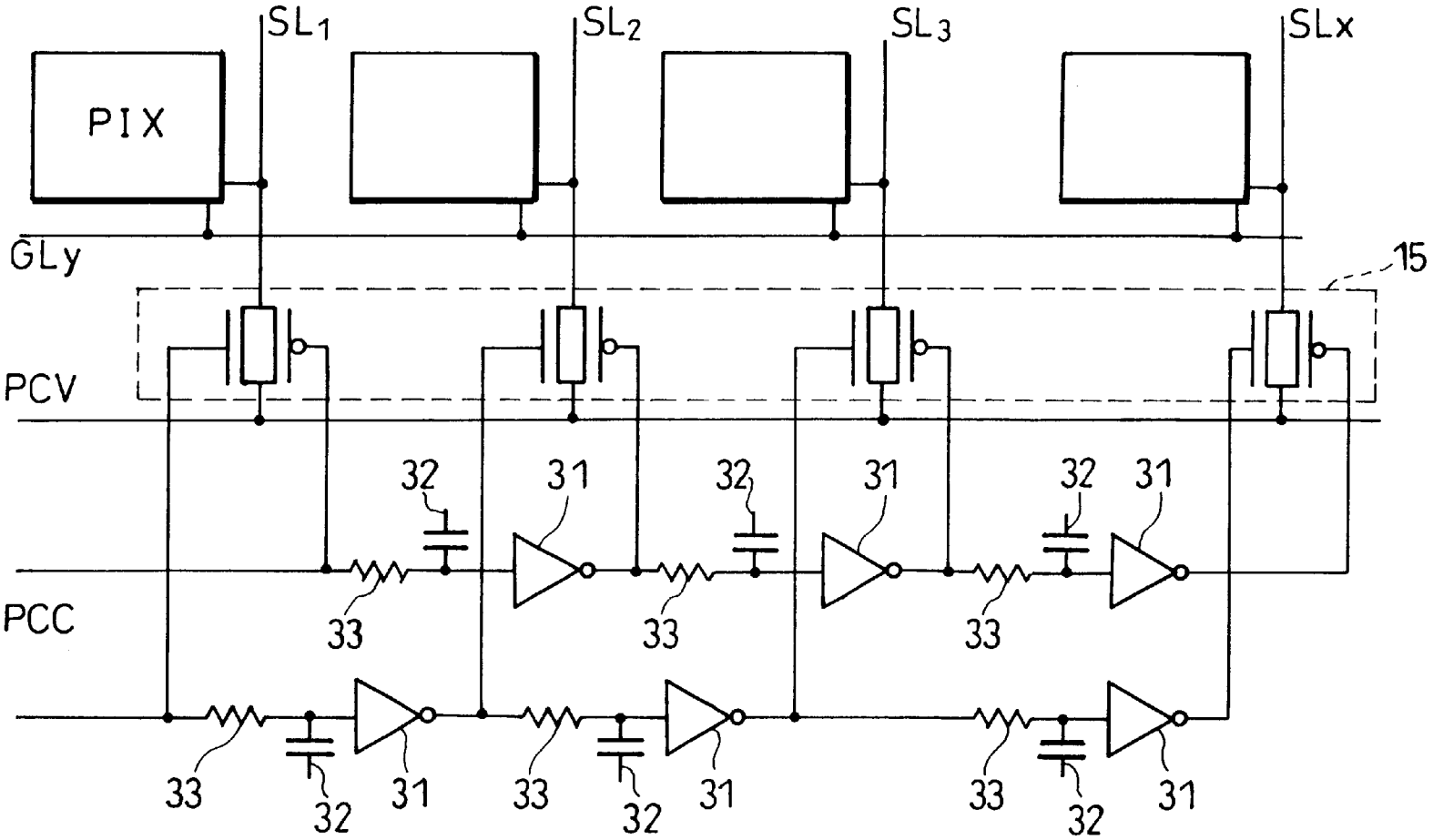
FIG. 11 is a circuit diagram illustrating still another arrangement of delay circuits in a precharge circuit in accordance with the present invention.

FIG. 11 is a view illustrating still another arrangement of the delay circuits 13 of the precharge circuit 11 of the present invention. In the arrangement shown in FIG. 11, the delay circuit 13 for delaying the precharge control signal PCC is composed of an additional capacitor or wire capacitor 32, a wire resistor 33, and an inverter circuit 31. A driving force and an input load are determined by appropriately varying a capacitance of the additional capacitor or wire capacitor 32, a resistance of the wire resistor 33, and a size of the inverter circuit 31, that is, channel lengths and widths of transistors composing the inverter circuit 31. As a result, an optimal delay is set.

Figure 12:
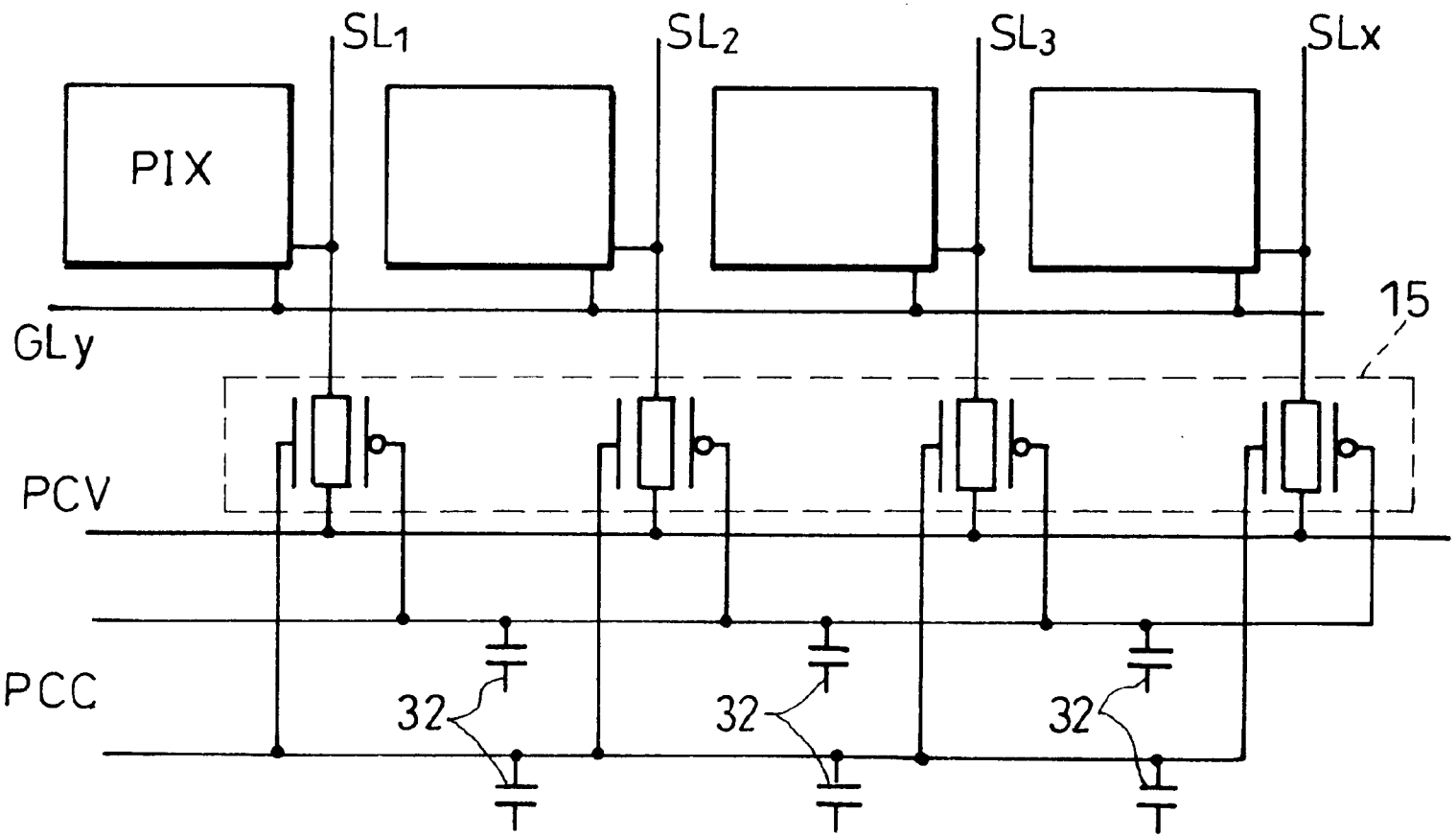
FIG. 12 is a circuit diagram illustrating still another arrangement of delay circuits in a precharge circuit in accordance with the present invention.

FIG. 12 is a view illustrating still another arrangement of the delay circuits of the precharge circuit 11 of the present invention. In the arrangement shown in FIG. 12, the delay circuit 13 for delaying the precharge control signal PCC is composed of an additional capacitor or wire capacitor 32. An optimal delay can be set by appropriately setting a capacitance of the additional capacitor or wire capacitor 32.

Figure 13:
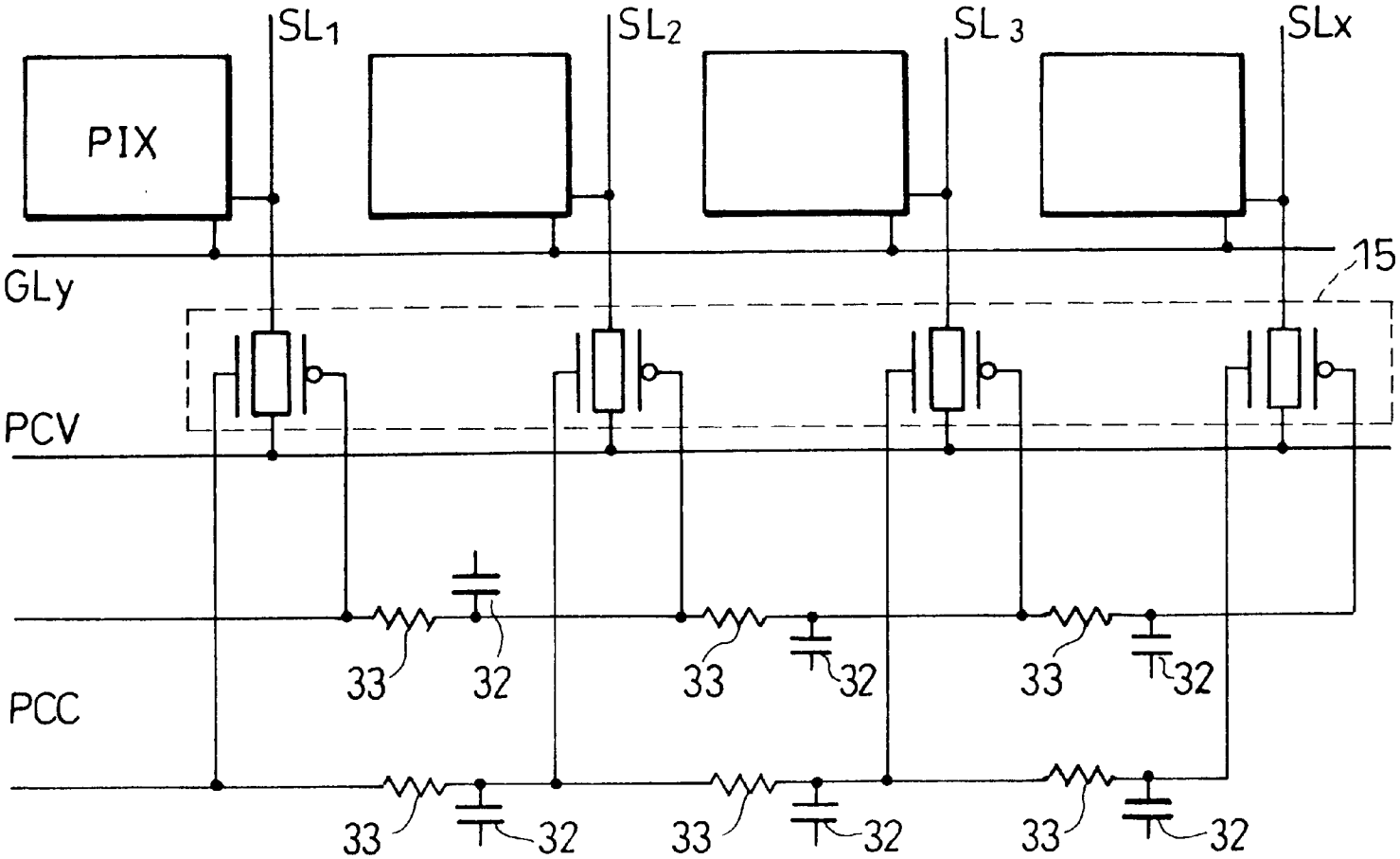
FIG. 13 is a circuit diagram illustrating still another arrangement of delay circuits in a precharge circuit in accordance with the present invention.

FIG. 13 is a view illustrating still another arrangement of the delay circuits 13 of the precharge circuit 11 of the present invention. In the arrangement shown in FIG. 13, the delay circuit 13 for delaying the precharge control signal PCC is composed of an additional capacitor or wire capacitor 32 and a wire resistor 33. An optimal delay can be set by appropriately setting a capacitance of the additional capacitor or wire capacitor 32 and a resistance of the wire resistor 33.

Figure 14:
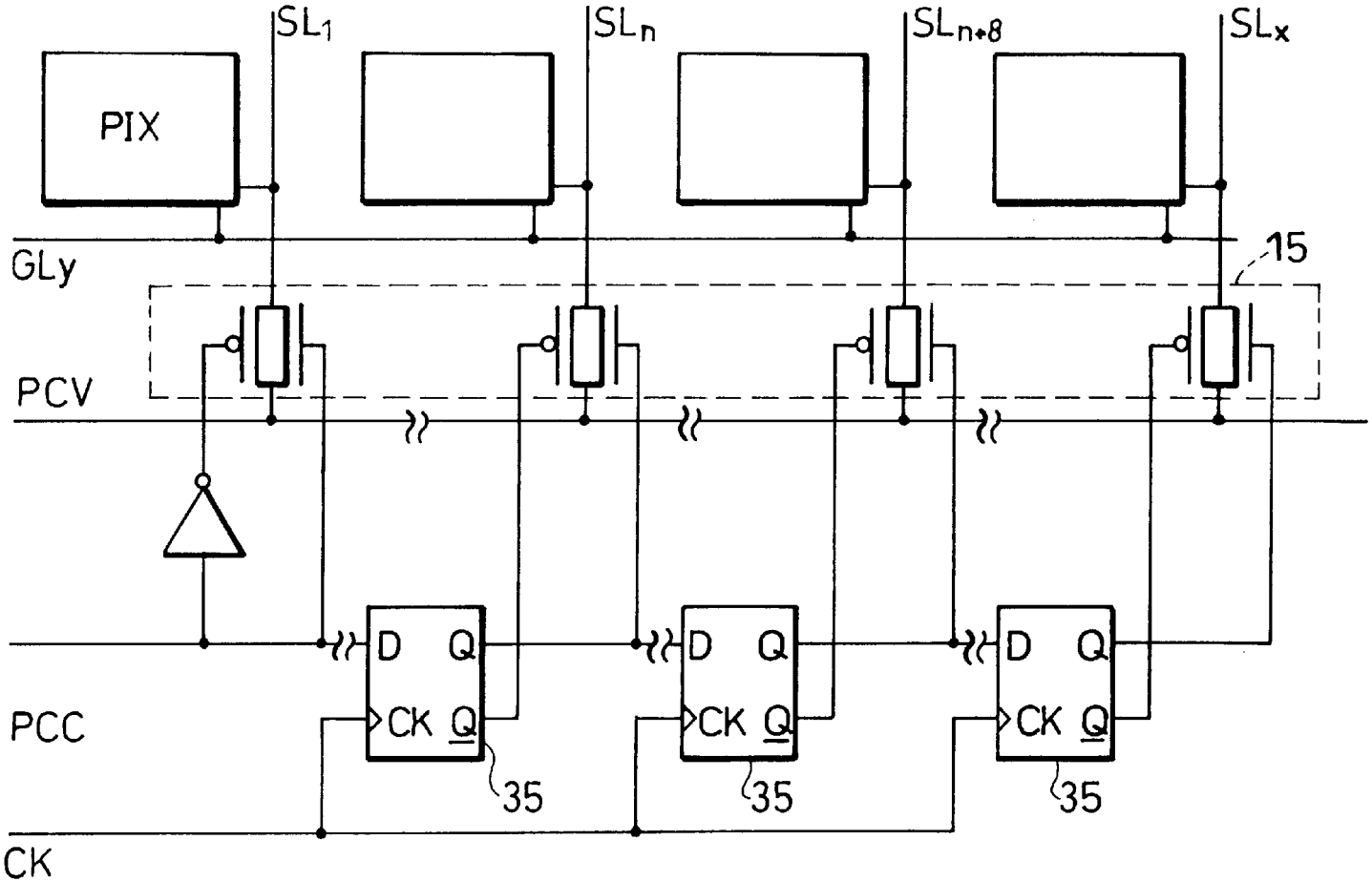
FIG. 14 is a circuit diagram illustrating still another arrangement of delay circuits in a precharge circuit in accordance with the present invention.

FIG. 14 is a view illustrating still another arrangement of the delay circuit 13 of the precharge circuit 11 of the present invention. In the arrangement shown in FIG. 14, the delay circuit 13 for delaying the precharge control signal PCC is composed of a flip-flop circuit 35. The flip-flop circuit 35 is designed so as to transfer the precharge control signal PCC in synchronization with the clock signal CK. An optimal delay can be set by appropriately setting a frequency of the clock signal.

[Third Embodiment]

Figure 15:
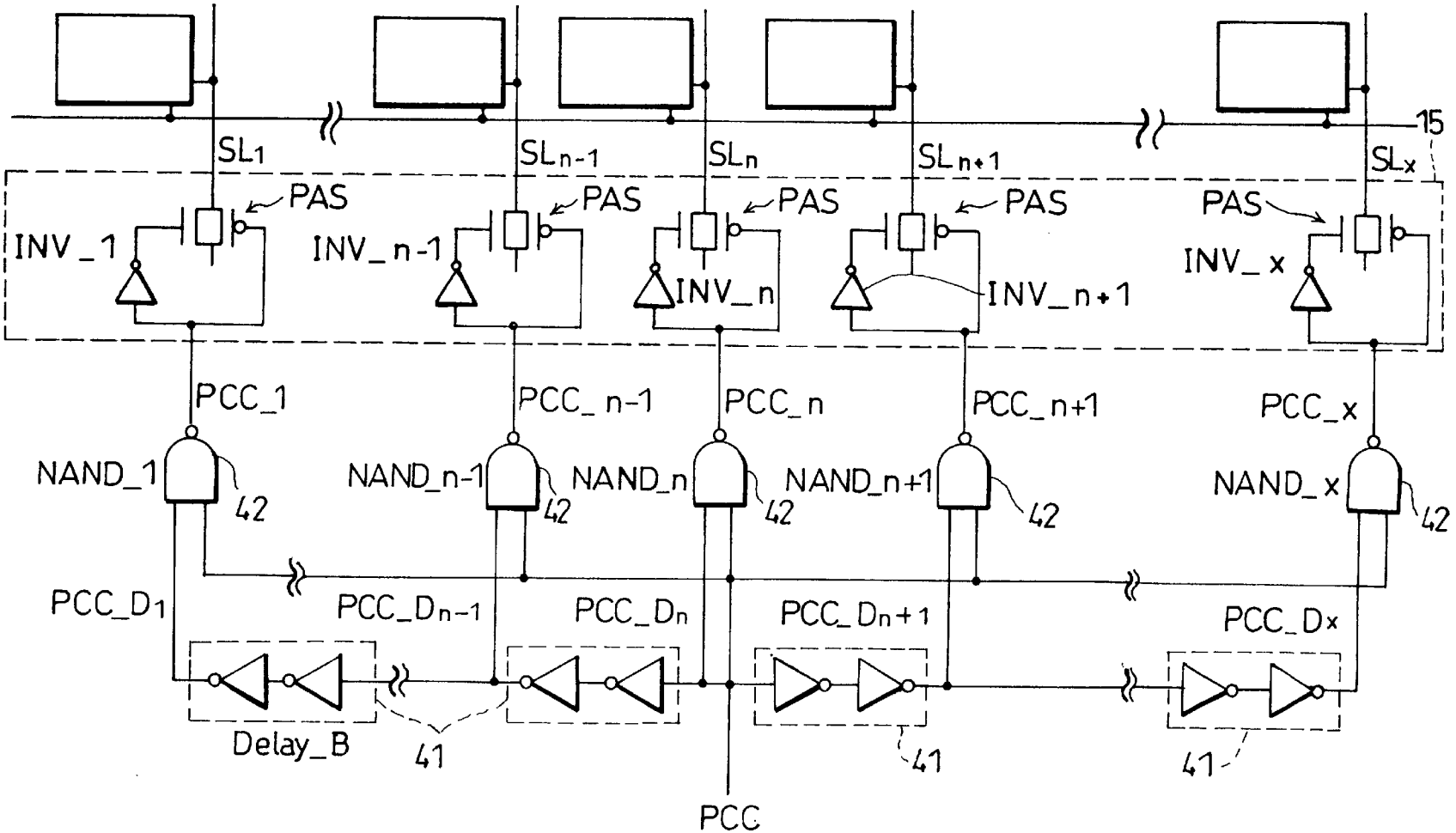
FIG. 15 is a circuit diagram illustrating still another arrangement of delay circuits in a precharge circuit in accordance with the present invention.

The following description will explain another embodiment of the present invention, while referring to FIG. 15 that illustrates an arrangement of an image display device in accordance with the present invention.

An image display device, whose circuit arrangement is shown in a circuit block diagram of FIG. 15, is composed of (i) delay circuits (delay _B) 41 each of which is composed of two stages of inverters and which corresponds to a plurality of the delay circuits 13, (ii) a reference signal switching section 15, and (iii) a plurality of NAND circuits (NAND_1 to NAND_n to NAND_x) 42 for outputting signals (PCC_1 to PCC_n to PCC_x) for driving switching elements PAS of the reference signal switching section 15, based on the precharge control signal PCC and outputs (PCC_$D_1$ to PCC_$D_n$ to PCC_$D_x$) of the delay circuits 41.

Though details of this will be described later, note that these NAND circuits function as an operation period control section and a switching control section.

Further, the precharge control signal PCC is fed from a central part of the precharge circuit 11, and as the precharge control signal PCC is transferred toward both the ends of the precharge circuit 11, the data signal lines are precharged in response to the precharge control signal PCC supplied via the delay circuits 41.

Incidentally, though not shown in the figures, in the case where the precharge control signal PCC has a potential lower than the power source voltage of the circuit arranged as shown in the figure, a signal amplitude amplifying section may be further provided in the arrangement. Also, the precharge control signal PCC may be inputted from both sides of the precharge circuit 11. The delay circuits 41 may also have a function of current increase as well as signal delay, may be capable of adjusting delay by using CMOS inverters arranged so that channel widths and lengths of their p-channel transistors and n-channel transistors are varied and adjusted so as to adjust delay, or may use wire resistors and additional capacitors or wire capacitors. A flip-flop circuit may also be used as the delay circuit.

Figure 16:
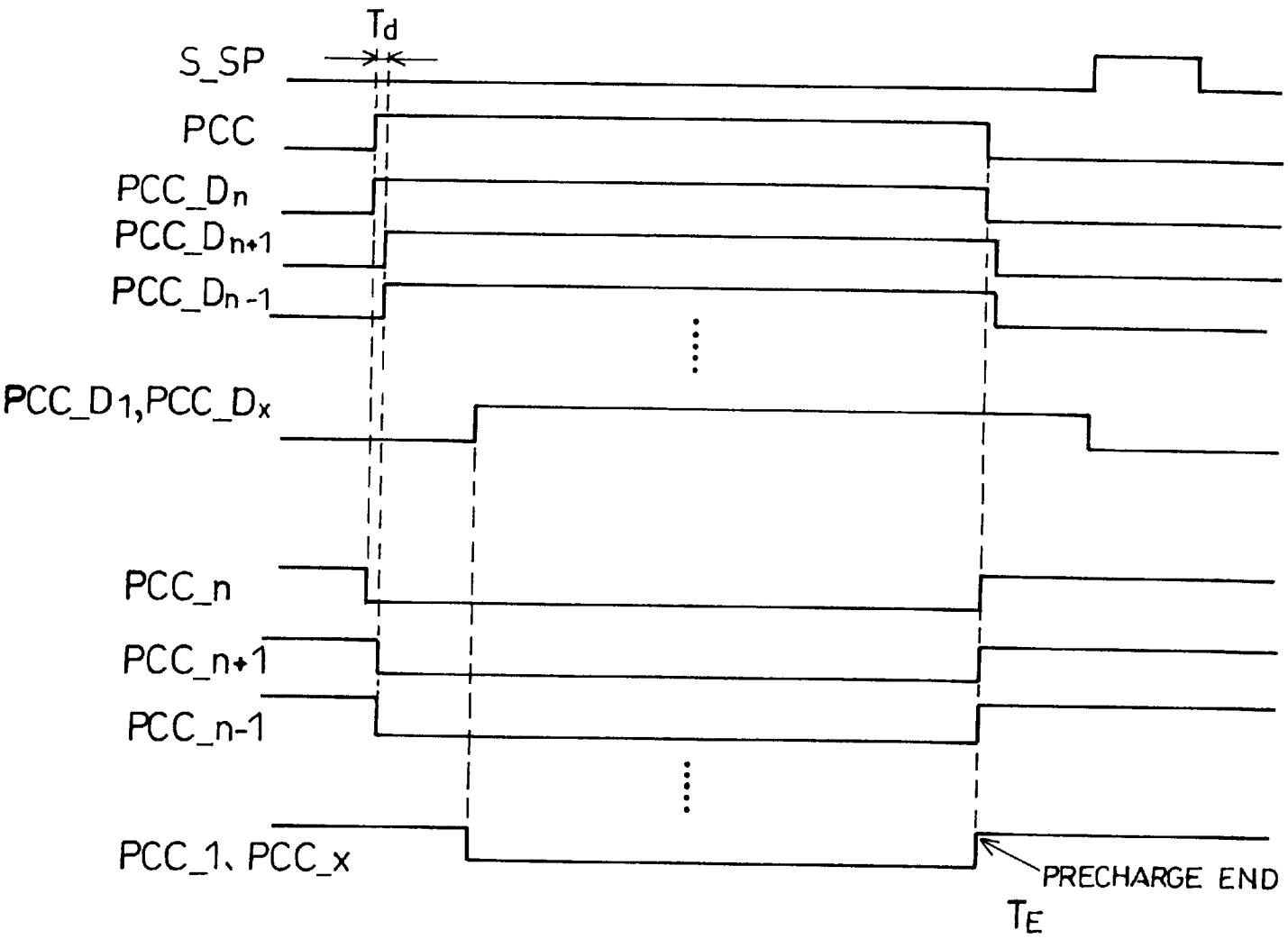
FIG. 16 is an explanatory view of a timing chart with regard to the delay circuits shown in FIG. 15.

The following description will explain the operation of the present embodiment, while referring to FIG. 16. Shown in the timing chart of FIG. 16 are a start signal S_SP fed to the data signal line driving circuit, the precharge control signal PCC fed to the precharge circuit, outputs PCC_$D_1$ to PCC_$D_n$ to PCC_$D_x$ of the delay circuits shown in FIG. 15, and signals PCC_1 to PCC_n to PCC_x. In the figure, $T_d$ represents a signal delay corresponding to one stage of a delay circuit. Further, $T_E$ represents a time of precharge end.

The precharge control signal PCC is fed to the NAND circuits NAND_1 to NAND_n to NAND_x, for output and logical operation by each delay circuit. Each of the outputs PCC_$D_1$ to PCC_$D_n$ to PCC_$D_x$ of the delay circuits is outputted with a delay from the input of the precharge control signal PCC, the delay being a product of the signal delay $T_d$ and the number of delay circuits the signal has passed, as shown in FIG. 16. While the outputs PCC_$D_1$ to PCC_$D_n$ to PCC_$D_x$ of the delay circuits and the precharge control signal PCC are HIGH, the signals PCC_1 to PCC_n to PCC_x of the NAND circuits NAND_1 to NAND_n to NAND_x are LOW, thereby causing the switching elements PAS composing the reference signal switching section 15 to become ON, whereby a precharge reference potential is inputted to the data signal lines. Then, while the precharge control signal PCC is LOW, the signals PCC_1 to PCC_n to PCC_x of the NAND circuits NAND_1 to NAND_n to NAND_x are HIGH irrespective of the states of the outputs PCC_$D_1$ to PCC_$D_n$ to PCC_$D_x$ of the delay circuits, thereby causing the switching elements PAS composing the reference signal switching section 15 to become OFF, whereby the charging of the data signal lines $SL_1$ to $SL_n$ to $SL_x$ is stopped. Incidentally, with a plurality of the NAND circuits functioning as above, the switching control section can be realized.

This makes the precharge of the data signal lines $SL_1$ to $SL_n$ to $SL_x$ finish simultaneously, thereby enabling to avoid fluctuation of the precharge reference potential caused by charges drawn therein upon a start of another sampling operation following to an end of a sampling operation applied to a certain data signal line. As a result, each data signal line is charged so as to have a desired potential.

Figure 17:
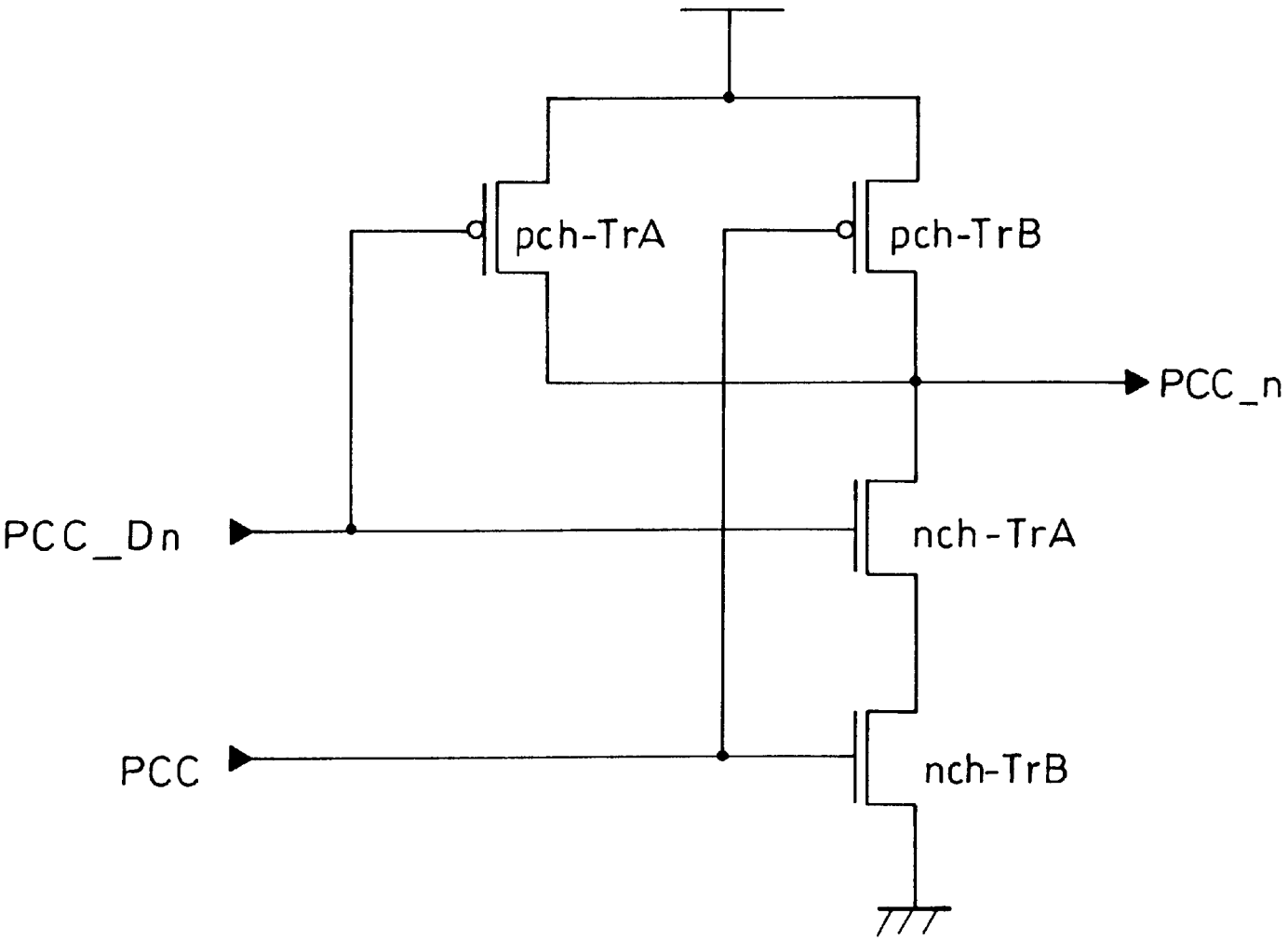
FIG. 17 is a circuit diagram illustrating an arrangement of a NAND circuit.
Figure 18:
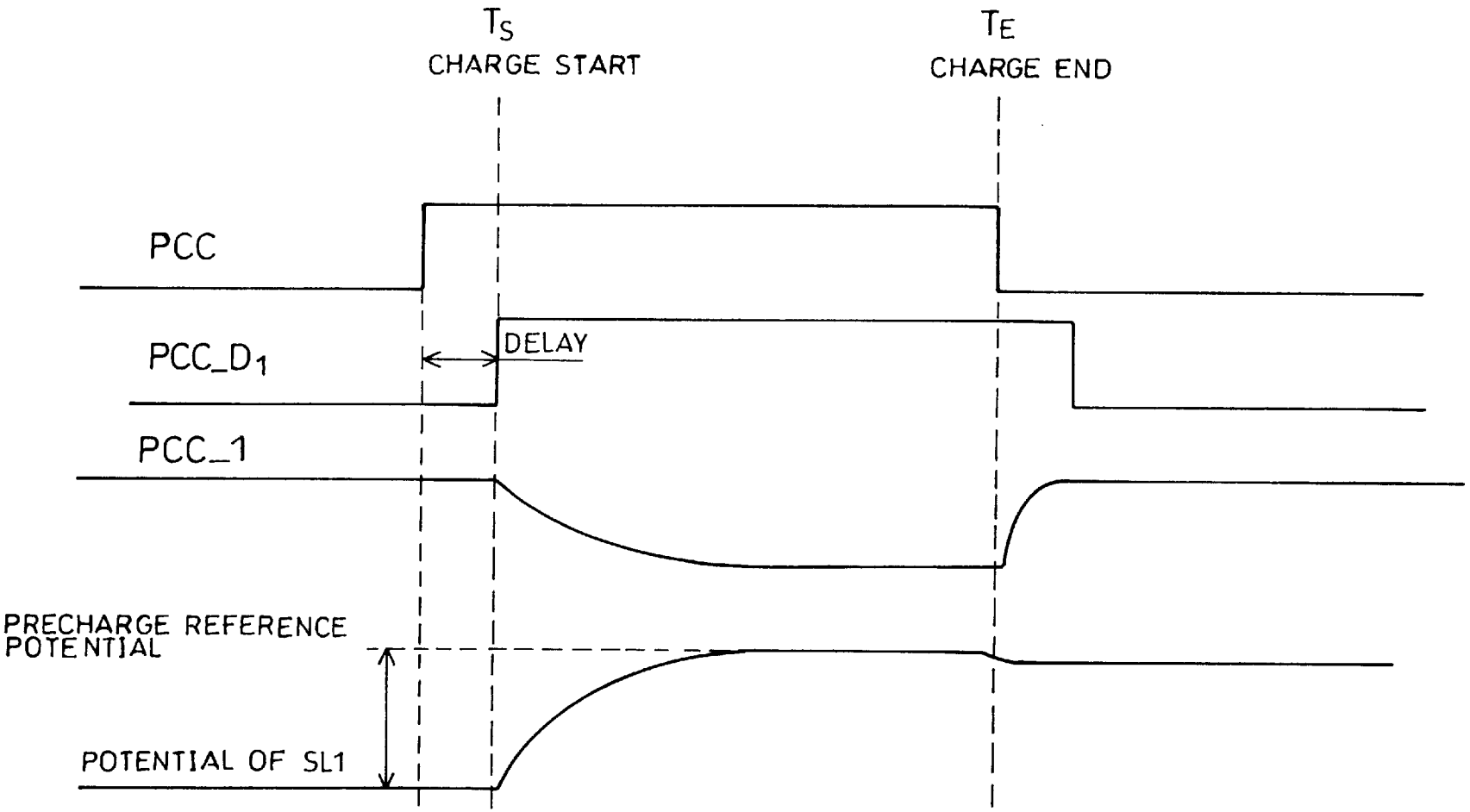
FIG. 18 is a timing chart of a switching operation of one switching element controlled by the delay circuits shown in FIG. 15.

Here, by changing channel lengths and widths of the transistors composing the NAND circuits NAND_1 to NAND_n to NAND_x, an operation period control section can be realized. The NAND circuit is usually composed of two p-channel transistors pch-TrA and pch-TrB and two n-channel transistors nch-TrA and nch-TrB as shown in FIG. 17, and in the present embodiment, the transistors nch-TrA and nch-TrB are designed so as to have narrow channel widths. With this, the transistors nch-TrA and nch-TrB become conductive when the outputs PCC_$D_1$ to PCC_$_{Dn}$ to PCC_$D_x$ of the delay circuits and the precharge control signal PCC are HIGH, but electric current flowing therethrough is small in quantity due to the narrowness of their channel widths, thereby making slow the switching operations of switching elements and inverters (INV_1 to INV_n to INV_x) at the subsequent stage. Thus, by causing each of the output signals PCC_1 to PCC_n to PCC_x of the NAND circuits NAND_1 to NAND_n to NAND_x to have a gradual fall and a sharp rise, as shown in FIG. 18, times when charges are transferred to the data signal lines $SL_1$ to $SL_n$ to $SL_x$ from the portions having the precharge reference potential are further dispersed, and this ensures that fluctuation of the precharge reference potential is further suppressed. In the figures, $T_S$ indicates a charge start time, while $T_E$ indicates a charge end time.

Incidentally, periods while the data signal lines $SL_1$ to $SL_n$ to $LS_x$ are charged are optimized by preliminarily controlling respective delays of the outputs PCC_$D_1$ and PCC_$D_x$ and the period of time from rise to fall of the precharge control signal PCC so that the charging can be completed within a period while the signals PCC_1 and PCC_x are LOW.

Furthermore, in the present embodiment, the precharge control signal PCC is used as the charge stop signal. Therefore, the timing of stop of the charging of the data signal lines $SL_1$ to $SL_n$ to $SL_x$ is determined in accordance with the fall of the precharge control signal PCC. However, alternatively, a signal other than the precharge control signal PCC may be fed as a charge stop signal from outside into the NAND circuits NAND_1 to NAND_n to NAND_x, for control of stop of the charging.

Figure 19:
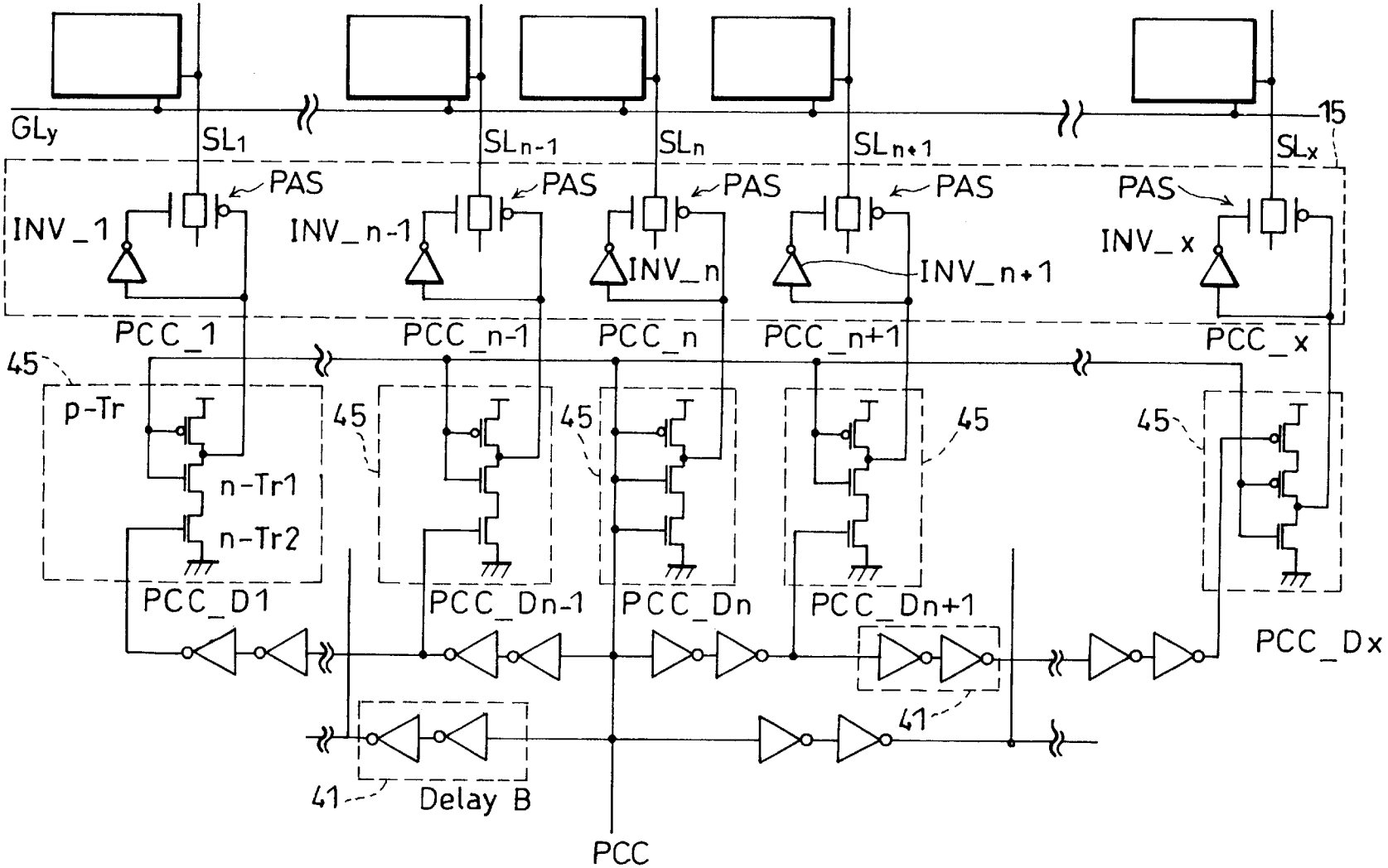
FIG. 19 is a circuit diagram illustrating still another arrangement of delay circuits in a precharge circuit in accordance with the present invention.

In the present embodiment, the outputs of the NAND circuits are used for generating the signals PCC_1 to PCC_n to PCC_x for controlling the charging of the data signal lines $SL_1$ to $SL_n$ to $SL_x$. However, alternatively, a circuit 45 composed of two n-channel transistors n-Tr1 and n-Tr2 and one p-channel transistor p-Tr as shown in FIG. 19 may be used. This arrangement also realizes the switching control section.

In the foregoing case, when the output PCC_$D_n$ becomes HIGH while the precharge control signal PCC is HIGH, the signal PCC_n becomes LOW, thereby causing the switching element PAS of the reference signal switching section 15 to become ON. When the precharge control signal PCC becomes LOW, the output of the signal PCC_n becomes HIGH, irrespective of the state of the output PCC_$D_n$ thereby causing the switching element PAS of the reference signal switching section 15 to become OFF. Thus, the charging of the data signal line $SL_n$ is finished. Each of the data signal lines $SL_1$ to $SL_{n-1}$ and $SL_{n+1}$ to $SL_x$ is likewise connected with the circuit 45, so as to be subjected to an identical operation.

In these cases as well, an operation period control section can be realized by varying channel lengths and widths of the transistors composing the circuit.

More specifically, the transistors nch-Tr1 and nch-Tr2 shown in FIG. 19 are designed so as to have narrow channel widths, so that electric current small in quantity flows therethrough. Therefore, the switching operations of switching elements and inverters (INV_1 to INV_n to INV_x) at the subsequent stage become slow. Times when charges are transferred to the data signal lines $SL_1$ to $SL_n$ to $SL_x$ from portions having the precharge reference potential are further dispersed, and this ensures that fluctuation of the precharge reference potential is further suppressed.

[Fourth Embodiment]

Figure 20:
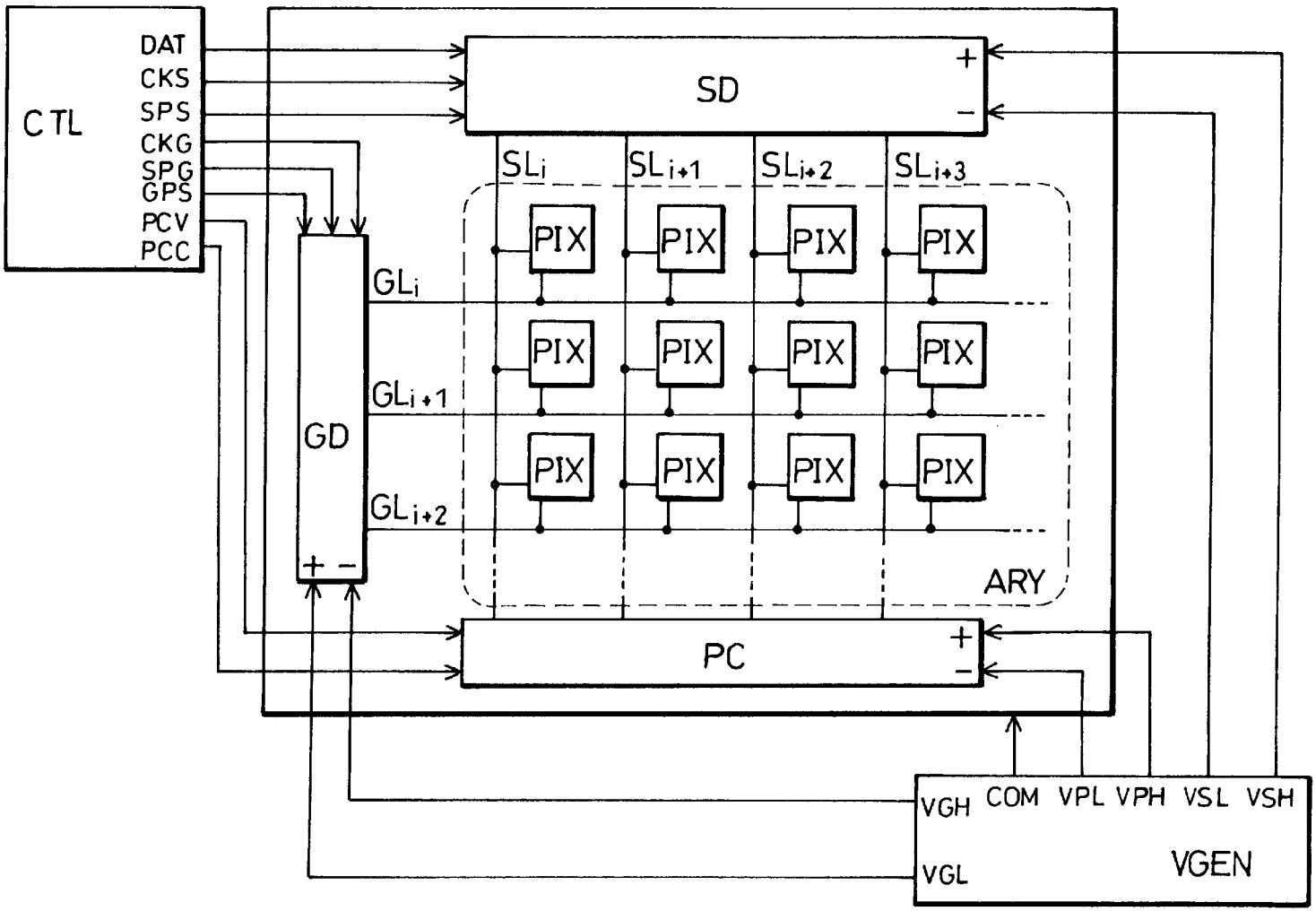
FIG. 20 is a circuit diagram illustrating still another arrangement of an image display device in accordance with the present invention.

The following description will explain an arrangement of an image display device of the present invention, while referring to drawings. FIG. 20 is a view illustrating still another arrangement of an image display device in accordance with the present invention. In the image display device shown in FIG. 20, pixels PIX, a data signal line driving circuit SD, a scanning signal line driving circuit GD, and a precharge circuit PC are all provided on a substrate SUB (driver monolithic structure), and are actuated with use of a signal fed from an external control circuit CTL and a driving power source of an external power source circuit VGEN.

In this arrangement, since the precharge circuit, the data signal line driving circuit, and the scanning signal line driving circuit are dispersedly disposed in an area with a length substantially equal to that of a screen (display region), input signal lines, etc., are designed to be extremely long. This extremely increases load capacitance (wire capacitance) of each input signal line. As a result, a great power saving effect can be effectively achieved by reducing the signal amplitude.

Furthermore, by providing the precharge circuit, data signal line driving circuit, and scanning signal line driving circuit on the same substrate that pixels are provided on, costs for manufacture and mounting of the driving circuit can be reduced, while reliability is effectively improved.

Figure 21:
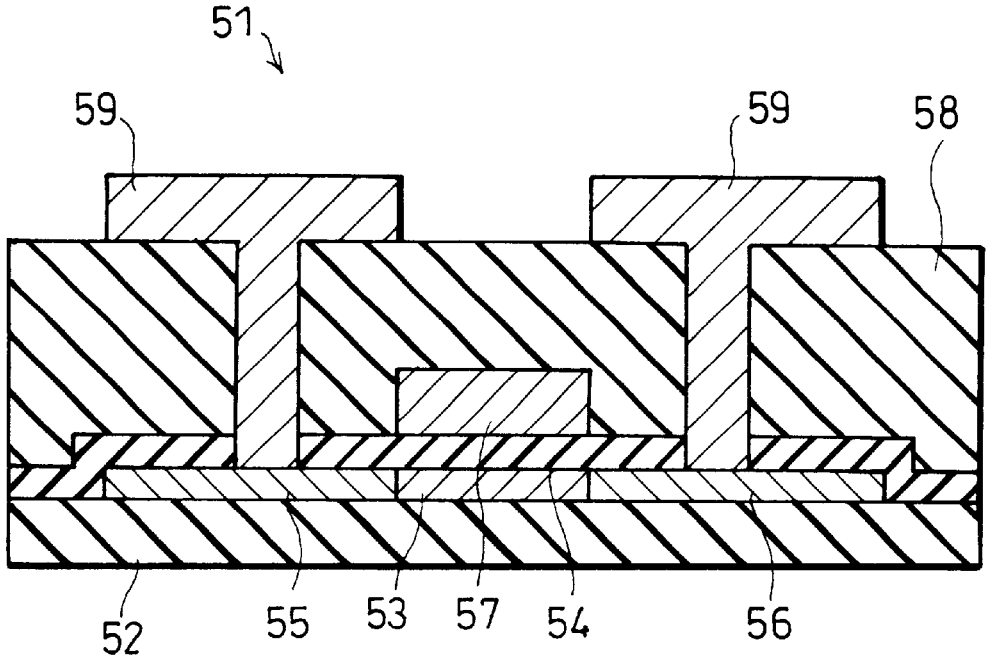
FIG. 21 is a cross-sectional view illustrating a cross-sectional arrangement of a polycrystalline silicon thin film transistor composing an image display device in accordance with the present invention.
Figure 22A:
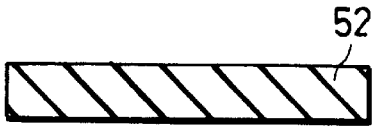
FIGS. 22(*a*) through 22(*k*) are cross-sectional views illustrating a process of fabrication of a polycrystalline silicon thin film transistor composing an image display device in accordance with the present invention.
Figure 22B:
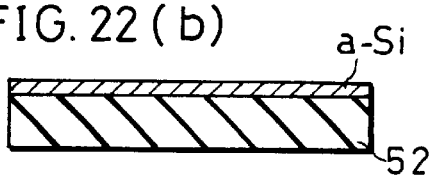
Figure 22C:
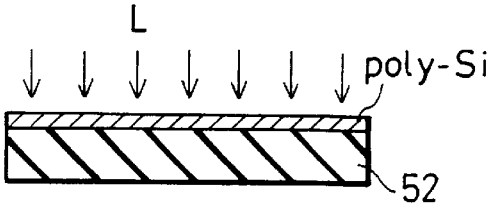
Figure 22D:
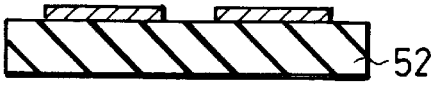
Figure 22E:
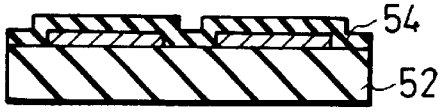
Figure 22F:
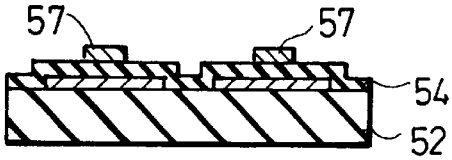
Figure 22G:
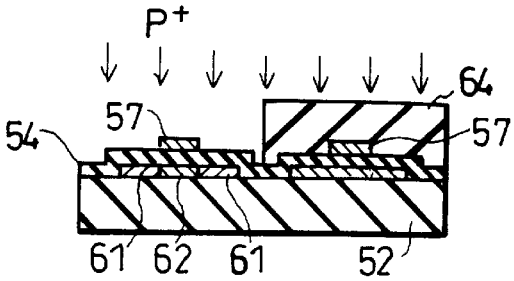
Figure 22H:
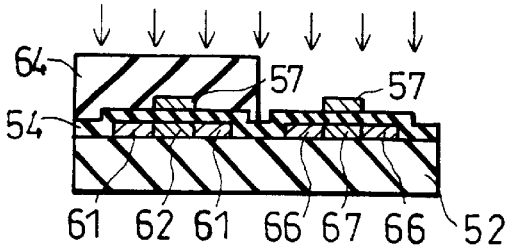
Figure 22I:
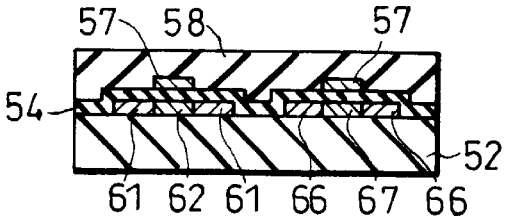
Figure 22J:
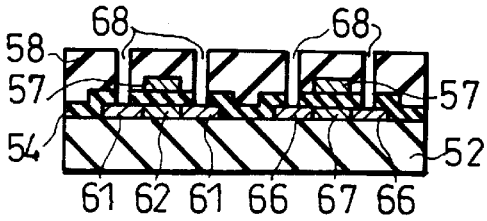
Figure 22K:
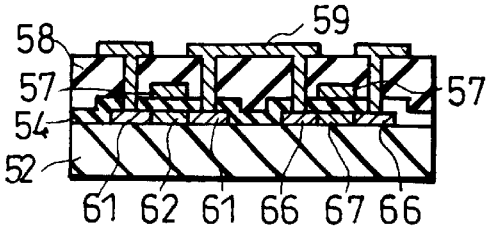
Figure 23:
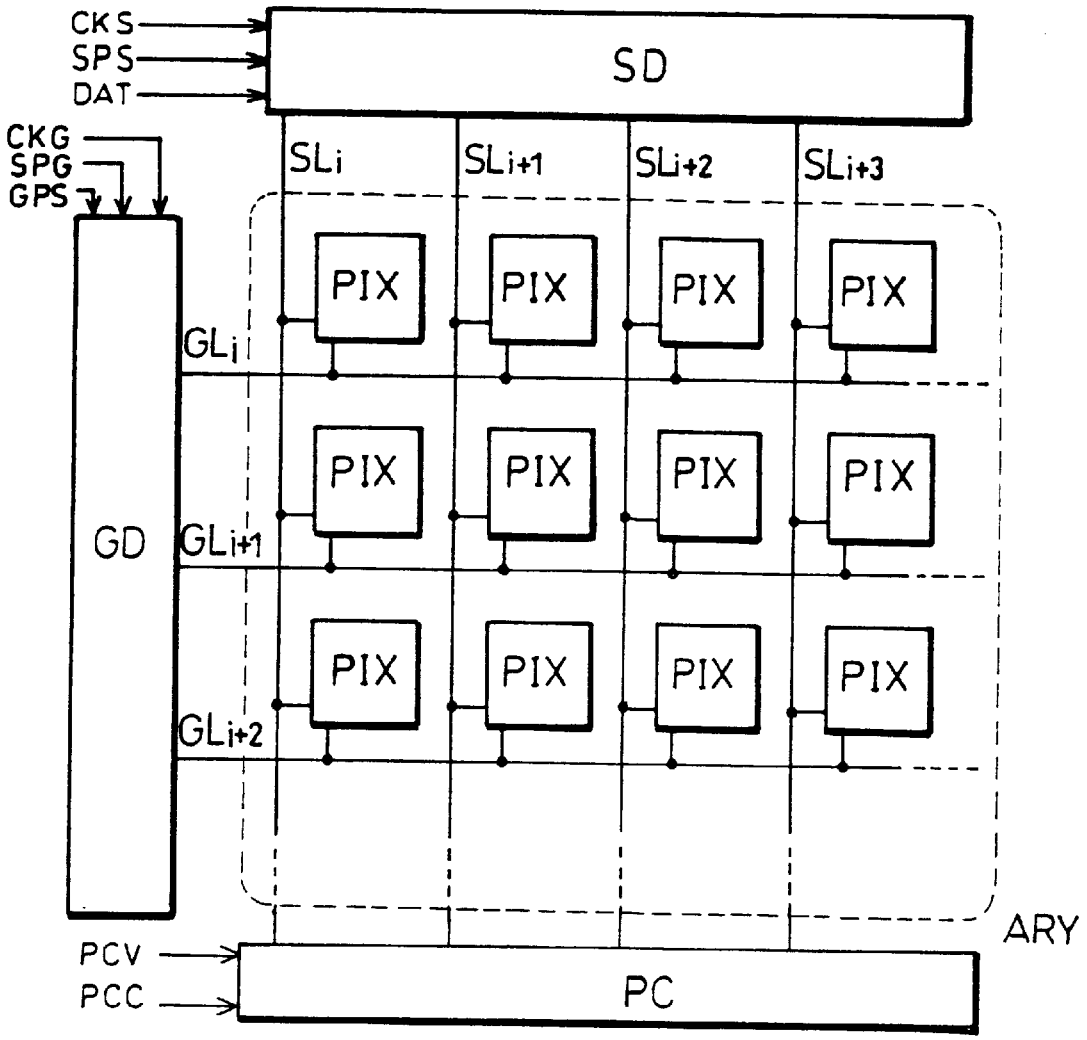
FIG. 23 PRIOR ART
FIG. 23 is a circuit diagram illustrating an arrangement of a conventional image display device.
Figure 24:
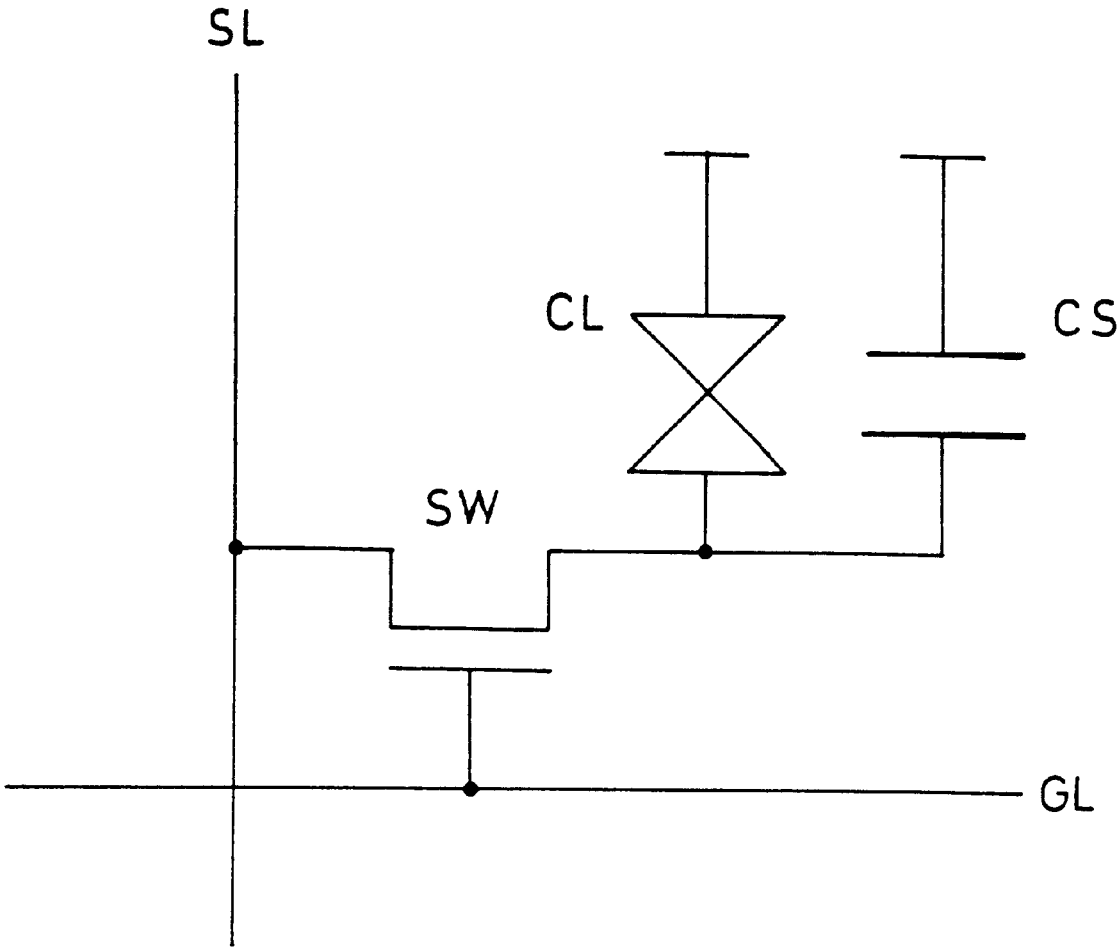
FIG. 24 PRIOR ART
FIG. 24 is a circuit diagram illustrating an arrangement of a pixel in a conventional image display device.
Figure 25:
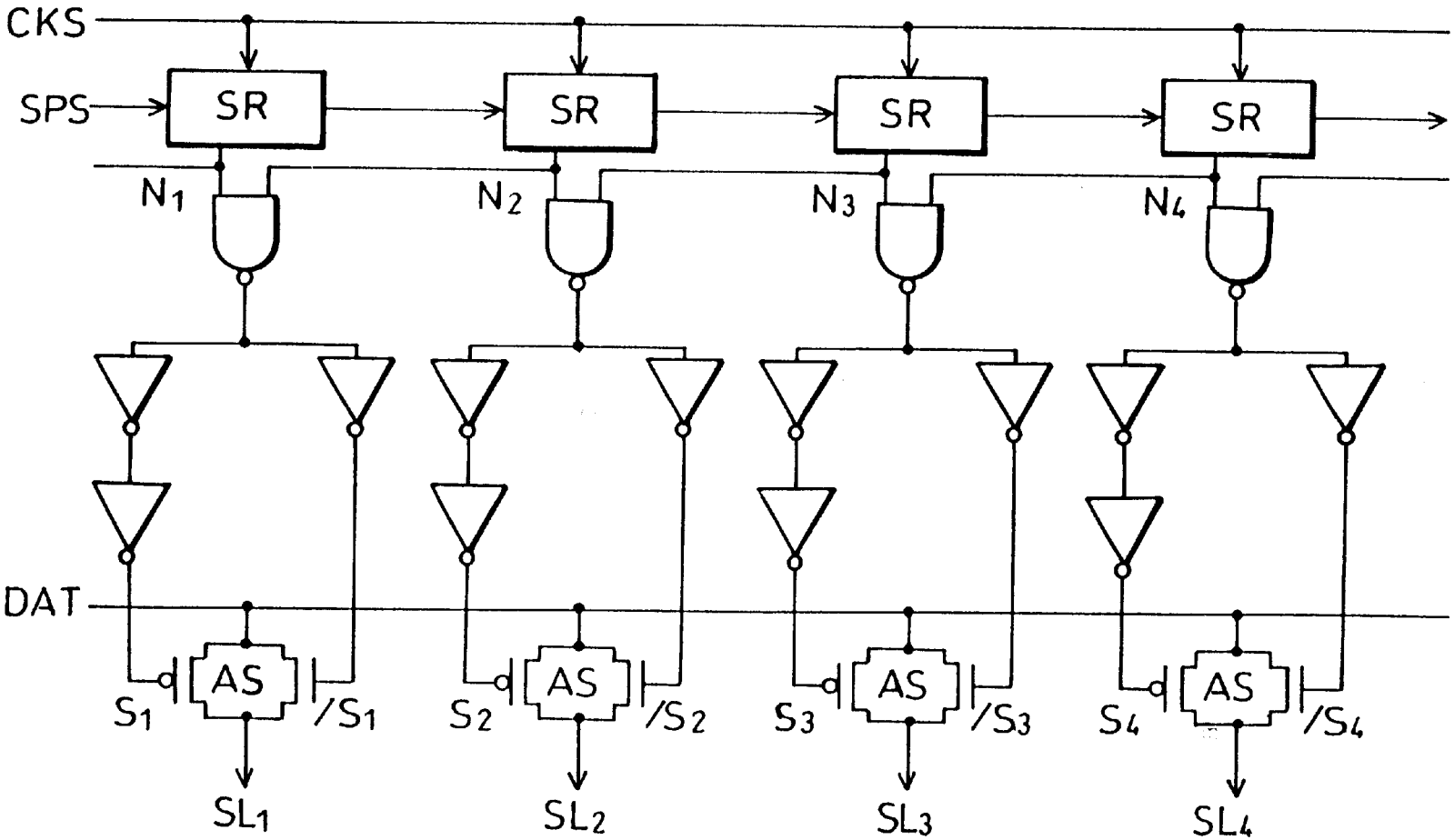
FIG. 25 PRIOR ART
FIG. 25 is a circuit diagram illustrating an arrangement of a data signal line driving circuit in a conventional image display device.
Figure 26:
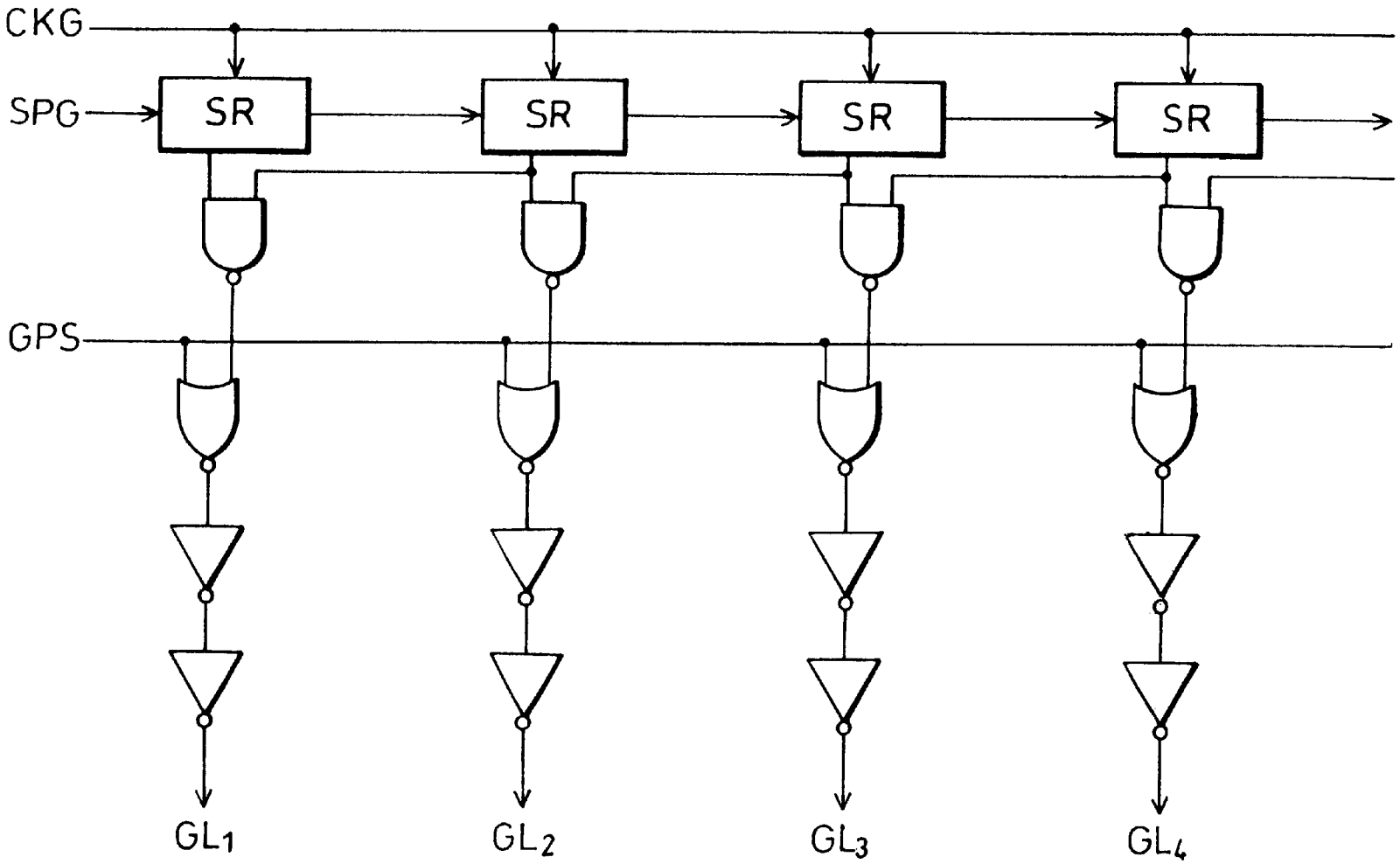
FIG. 26 PRIOR ART
FIG. 26 is a circuit diagram illustrating an arrangement of a scanning signal line driving circuit in a conventional image display device.
Figure 27:
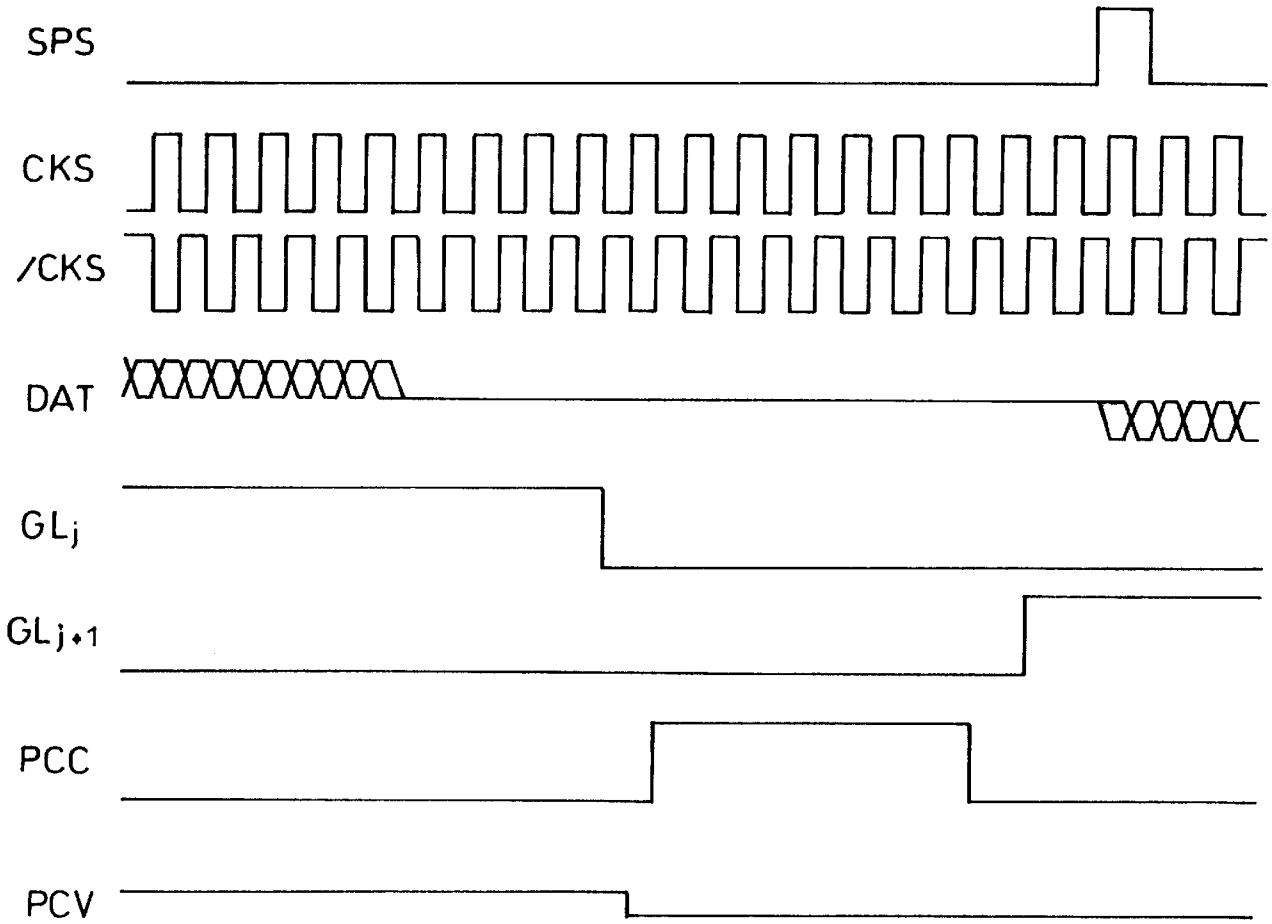
FIG. 27 PRIOR ART
FIG. 27 is an explanatory view illustrating an example of driving signal waveform of a conventional image display device.
Figure 28:
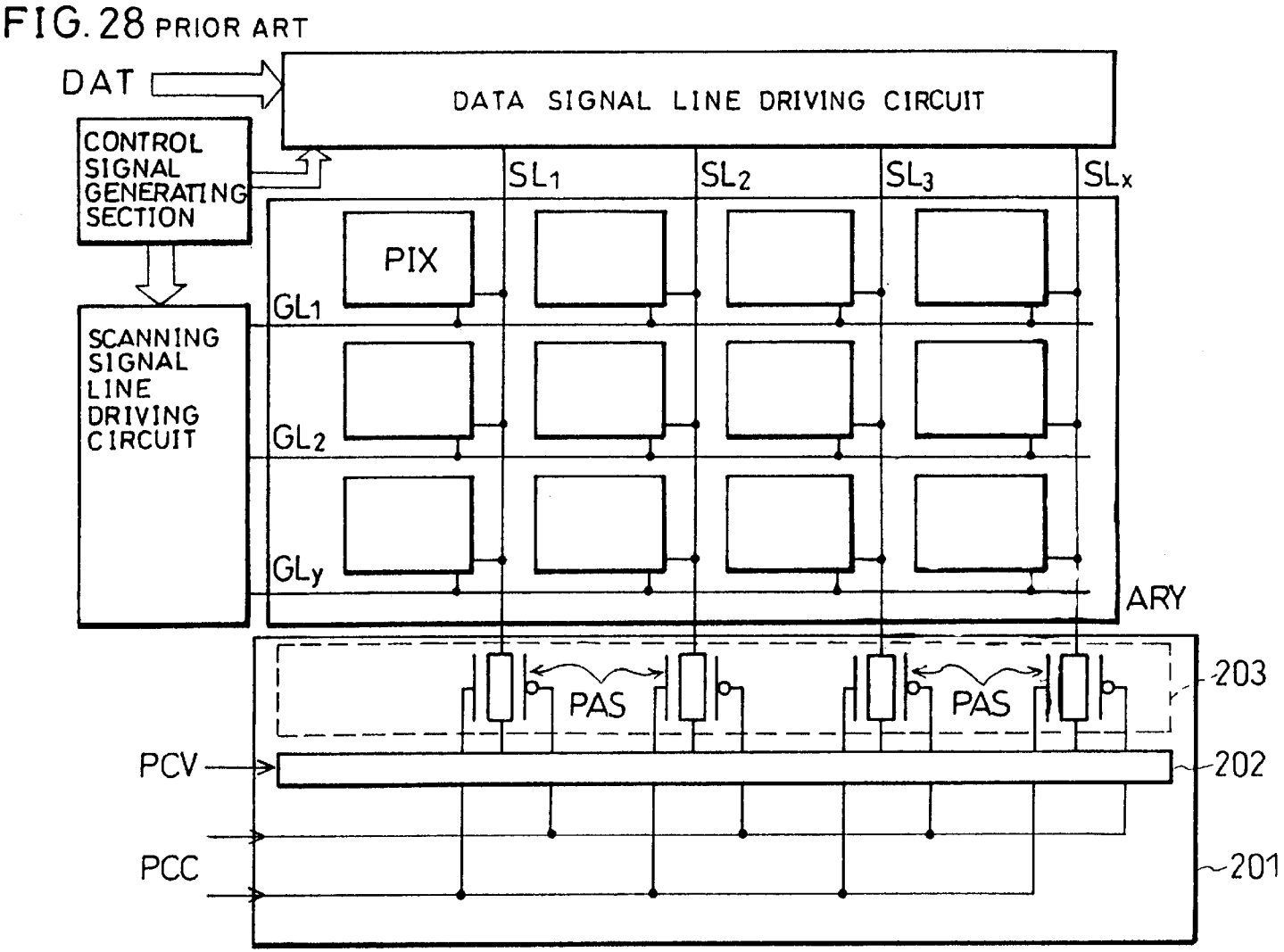
FIG. 28 PRIOR ART
FIG. 28 is a block diagram illustrating an arrangement of a conventional image display device and precharge circuit.
Figure 29:
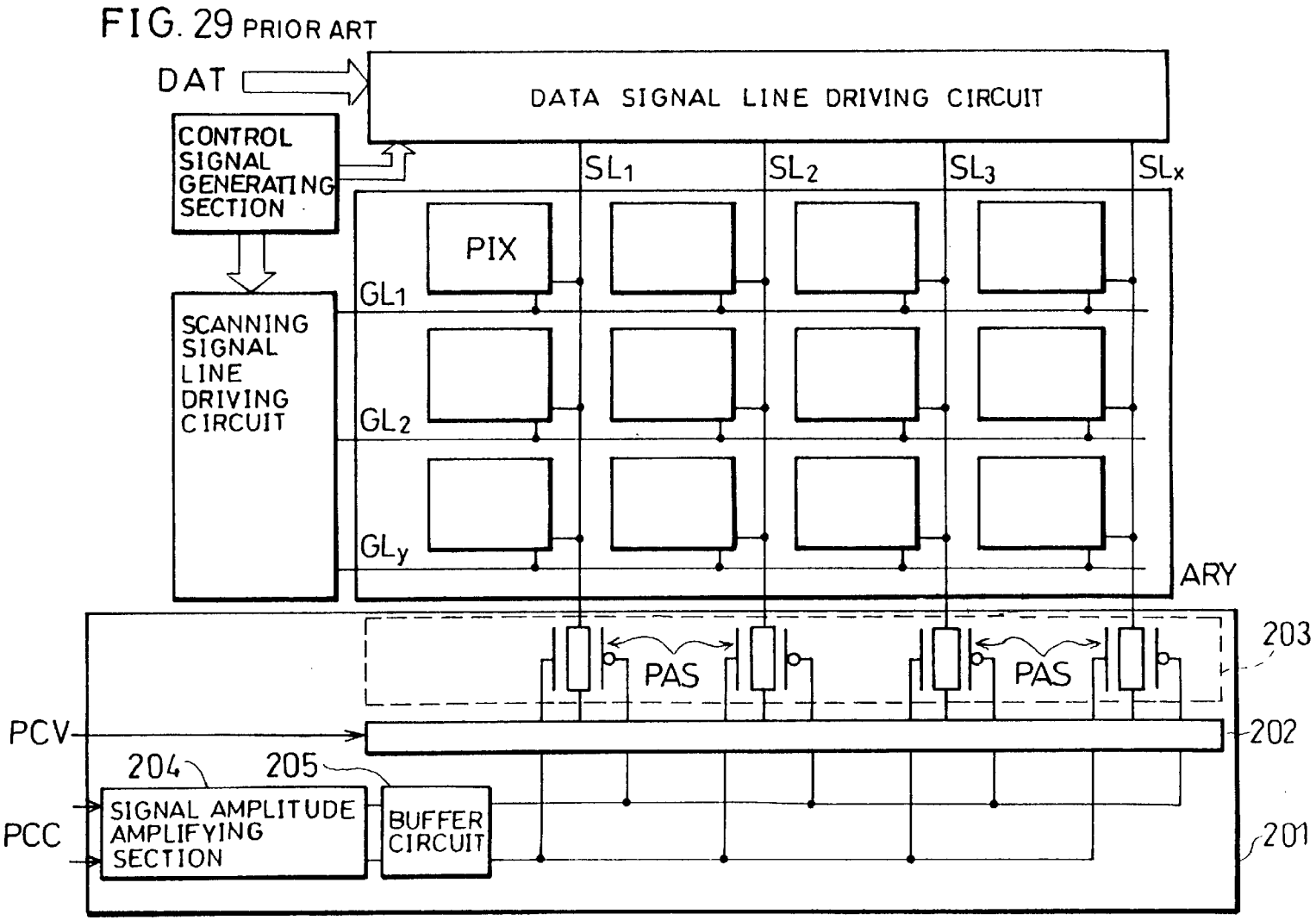
FIG. 29 PRIOR ART
FIG. 29 is a block diagram illustrating another arrangement of a conventional image display device and precharge circuit.

FIG. 21 is a view illustrating an example of an arrangement of a polycrystalline silicon thin film transistor composing an image display device in accordance with the present invention. A polycrystalline silicon thin film transistor 51 is arranged so as to include a source electrode 55, an active layer 53 formed with a polycrystalline silicon thin film, a drain electrode 56, a gate insulating film 54, a gate electrode 57, an interlayer insulating film 58, and a metal wire 59 that are laminated upon an insulating substrate 52.

The polycrystalline silicon thin film transistor 51 shown in FIG. 21 is in a normal stagger (top gate) structure in which the polycrystalline silicon thin film on the insulating substrate 52 is the active layer 53. This invention, however, is not strictly limited to this, but another structure such as an inverted stagger structure may be applicable.

By using the foregoing polycrystalline silicon thin film transistor, the precharge circuit, scanning signal line driving circuit, and data signal line driving circuit that have practical driving capability are formed on the same substrate on that the pixel array is also provided, through substantially one and same fabrication process.

FIGS. 22(*a*) through 22(*k*) are cross-sectional views illustrating an example of a fabrication process of a polycrystalline silicon thin film transistor composing an image display device in accordance with the present invention. A fabrication process of a polycrystalline silicon thin film transistor in which the highest temperature in the process is generally not higher than 600° C. is briefly explained below. FIGS. 22 (*a*) through 22(*k*) are cross-sectional views illustrating respective steps of the process.

As shown in FIG. 22(*a*), the insulating substrate (hereinafter referred to as a substrate) 52 made of glass or the like is prepared. Next, as shown in FIG. 22(*b*), an amorphus silicon thin film (a-Si) or the like is deposited on the substrate 52. Subsequently, as shown in FIG. 22(*c*), eximer laser L is projected on the film thus deposited on the substrate, to form a polycrystalline silicon thin film (poly-Si). Then, as shown in FIG. 22(*d*), the polycrystalline silicon thin film is subjected to patterning to a desired shape. As shown in FIG. 22(*e*), then, the gate insulating film 54 made of silicon dioxide is formed. Further, as shown in FIG. 22(*f*), the gate electrode 57 of the thin film transistor is formed with aluminum or the like. Thereafter, as shown in FIGS. 22(*g*) and 22(*h*), impurities are implanted in source and drain regions of the thin film transistor (phosphorus ions $P^+$ are implanted into an n-channel region, while boron ions $B^+$ into a p-channel region). On parts into which impurities are not implanted, a resist 64 is provided. By the implantation of phosphorus ions $P^+$, an n-channel region 61 and a region 62 surrounded by the same are formed. By the implantation of boron ions $B^+$, a p-channel region 66 and a region 67 surrounded by the same are formed. Thereafter, as shown in FIG. 22(*i*), the interlayer insulating film 58 made of silicon dioxide, silicon nitride, or the like is deposited. Then, as shown in FIG. 22(*j*), a contact hole 68 is bored in the interlayer insulating film 58 and the gate insulating film 54. Finally, as shown in FIG. 22(*k*), the metal wire 59 made of aluminum or the like is formed. Since in this process the highest temperature is 600° C. upon formation of the gate insulating film 54, glass with high thermal resistance such as 1737 glass available from Corning Inc. (U.S.) is applicable.

Incidentally, in the case of a liquid crystal display device, this process is further followed by a step of forming a transparent electrode (in the case of a transparent liquid crystal display device) or a reflection electrode (in the case of a reflection-type liquid crystal display device), with another interlayer insulating film provided therebetween.

By forming a polycrystalline silicon thin film transistor through the process shown in FIGS. 22(*a*) through 22(*k*) at a temperature generally not higher than 600° C., a glass substrate that is inexpensive and has a large area is applicable, thereby enabling reduction of manufacturing costs of an image display device that has a larger screen.

The present invention has been concretely described by taking as examples various embodiments of a logical circuit of the present invention and embodiments of an image display device in which the logical circuit is applied. The invention being thus described, however, it will be obvious that the same may be varied in many ways as long as such variations do not deviate from the spirit and do not degrade the effect of the original.

In the present invention, the foregoing at least one control signal may be supplied to each of a plurality of the control signal input sections, and an output of each control signal input section may be fed to the signal delay sections connected with the control signal input section.

Furthermore, the control signal input section may be provided on each of ends on both sides of the precharge circuit, and a signal may be fed from each control signal input section to the signal delay sections.

Furthermore, the control signal input section may be disposed in the vicinity of center of the precharge circuit, and a signal is fed from the control signal input section to the signal delay sections.

Furthermore, the control signal input section may be connected with a plurality of the signal delay sections.

Furthermore, each of the signal delay sections may be connected with a plurality of active elements composing the reference signal switching section.

Furthermore, the image display device may further include an amplitude amplifying section functioning to amplify the control signal, at a stage subsequent to the control signal input section.

Furthermore, each of the signal delay sections may delay the control signal, as well as may amplify the control signal.

Furthermore, each of the signal delay sections may include a CMOS inverter circuit, at least one of channel widths and channel lengths of a p-channel transistor and an n-channel transistor of the CMOS inverter circuit being variable.

Furthermore, the signal delay sections may include CMOS inverter circuits that are arranged so that at least one of channel widths and channel lengths of a p-channel transistor and an n-channel transistor composing one CMOS inverter circuit composing one signal delay section differs from that of another CMOS inverter circuit that composes another signal delay section.

Furthermore, each of the signal delay section may include at least one of a wire capacitor and a wire resistor of a control signal line.

Furthermore, each of the signal delay section may include at least one of a wire capacitor, a wire resistor of a control signal line, and a CMOS inverter circuit.

Furthermore, each of the signal delay section may include a flip-flop circuit.

Furthermore, the precharge circuit may include an operation period control section for outputting a signal for controlling a period of a switching operation by the reference signal switching section for start or stop of precharge of each data signal line with the signal fed from the reference signal input section.

Furthermore, the precharge circuit may include a switching control section for outputting a signal for controlling the reference signal switching sections in accordance with outputs of the signal delay sections and a charge end signal for stopping charging of each data signal line to the precharge reference potential, and all the reference signal switching sections in the precharge circuit may simultaneously stop outputting of the precharge reference potential to each data signal line in response to the signal outputted by the switching control section.

Furthermore, the control signal may be used as the charge end signal to be fed to the switching control section.

Furthermore, at least one of the precharge circuit, the data signal line driving circuit, and the scanning signal line driving circuit may be provided on the same substrate that the pixels are provided on.

Furthermore, active elements composing the precharge circuit, the data signal line driving circuit, the scanning signal line driving circuit, and the pixels may be polycrystalline silicon thin film transistors.

Furthermore, the active elements may be formed through a process in which temperature substantially does not exceed 600° C.

With the foregoing image display device of the present invention, it is possible to leave an external circuit for supplying the precharge reference signal leeway in its driving capability, since a load on the external circuit becomes lighter as the peaks of current flowing through the precharge reference signal lines are dispersed in terms of time.

In the image display device of the present invention, a plurality of control signal input sections are further provided, and the precharge control signal is inputted to each control signal input section. This extremely facilitates to optimize delays of the precharge control signal produced by the delay circuits.

The image display device of the present invention is further arranged so that the control signal input section is provided on each of ends on both sides of the precharge circuit, through which signals are supplied to the display circuits. This enables sufficient precharge of all the data signal lines during the flyback period. Besides, the charging of the data signal lines on both sides to the precharge reference potential may be finished before the writing of image data into the data signal lines begins from either one of the data signal lines on both the sides, and furthermore, a sufficient precharge period can be ensured likewise for the data signal lines in the vicinity of the center of the precharge circuit, even in the case where the delays of the precharge control signal are larger, which are produced by the delay circuits in the data signal driving circuit.

The image display device of the present invention is further arranged so that the control signal input section is provided in the vicinity of the center, through which signals are supplied to the delay circuits. This enables sufficient precharge of all the data signal lines during the flyback period. Furthermore, as compared with the case where the precharge control signals are supplied from both sides, respectively, differences in delays of the precharge control signal in the vicinity of the center of the screen are eliminated, resulting in elimination of fluctuations of levels of the precharge reference potential that are caused according to deformation of the waveform of the precharge control signal and irregularities of timings of the same. If precharge states produced by the precharge control signal supplied from both sides greatly differ in the vicinity of the center of the image display device due to variation of component transistors, the screen display will be disordered, divided into areas due to differences. However, with input of the precharge control signal at the center of the image display device, such differences in the data signal precharge states due to variation of the transistors may occur between both sides, but area division due to differences in the precharge states does not occur in the vicinity of the center of the screen. As a result, the display quality is by no means deteriorated.

The image display device of the present invention is further arranged so that each control signal input section is connected with a plurality of the delay circuits, to allow the precharge control signal to be supplied to each delay circuit connected therewith. This makes the precharge control signal be controlled by each delay circuit so as to have an optimal delay. Therefore, it is possible to accurately set the delays at many, finely divided levels.

The image display device of the present invention is further arranged so that each delay circuit is connected with a plurality of switching elements. This enables achievement of the foregoing effects without an unnecessary excessive increase in the number of the delay circuits in the precharge circuit.

The image display device of the present invention is further arranged so that the precharge control signal is supplied via an amplitude amplifying section such as a level shifter. This enables control of the switching elements according to the precharge control signal delayed sequentially by the delay circuits, thereby causing times when charges are transferred to the data signal lines from portions having the precharge reference potential to be dispersed. Therefore, transfer of a great quantity of charges at once is prevented. As a result, fluctuation of the precharge reference potential is suppressed, and data signal lines are charged to desirable potential levels. Consequently, this ensures that deterioration of image quality is avoided, that a quantity of electric current for the precharge reference potential that is supplied from outside is decreased, and that an increase in power consumption is effectively suppressed. Furthermore, the precharge control signal supplied from outside can be made to be a signal of a low voltage (small amplitude), thereby resulting in that power consumption is further reduced.

The image display device of the present invention is further arranged so that the delay circuits delay the precharge control signal and have a function to amplify the precharge control signal as buffer circuits. This ensures a function to sequentially actuate a plurality of small buffer circuits, thereby allowing a load on the power source circuit to become lighter as the current consumed by the buffer circuits are dispersed in terms of time.

Furthermore, the number of switches actuated by each buffer circuit decreases as compared with conventional cases. Therefore, a driving power of each buffer circuit is allowed to be relatively smaller.

The image display device of the present invention is further arranged so that each of the delay circuits may include a CMOS inverter circuit, and that at least one of channel widths and channel lengths of a p-channel transistor and an n-channel transistor of the CMOS inverter circuit is variable. This allows the sizes of the transistors to vary, and by adjusting the channel widths and channel lengths, the delays produced by the delay circuits can be adjusted. As a result, a time spent in precharge, peak current, and the like can be optimized.

Furthermore, by arranging the buffer circuits (CMOS inverter circuits) so that at least one of channel widths and channel lengths of a transistor of the buffer circuit differs from that of another buffer circuit, dispersion of peaks of consumed current can be controlled.

The image display device of the present invention is further arranged so that the delay circuit is composed of at least one of a load capacitor (wire capacitor) and a wire resistor of a control signal line. This ensures that, if the switching element is close to the precharge control signal input side, the precharge control signal relatively abruptly changes and actuates the switching element, but the load capacitance (wire capacitance) and resistance increase as becoming farther from the input side, thereby making changes of the precharge control signal dull. This makes timings of the operations of the switching elements different, thereby ensuring a function identical to those of the delay circuits.

The image display device of the present invention is further arranged so that each of the delay circuit is composed of at least one of a load capacitor (wire capacitor) and a wire resistor of a precharge control signal line in the circuit, in addition to the CMOS inverter circuit. This enables to, by changing a layout (crossings, wire widths, and the like of the signal lines and the power source lines) of the precharge circuit, adjust delays and degrees of dullness of the precharge control signal, so that a precharge control signal deformed by the buffer circuit is obtained.

The image display device of the present invention is further arranged so that each of the signal delay section is composed of a flip-flop circuit. By inputting signals (the clock signal and the precharge control signal) for controlling the flip-flop circuit and sequentially delaying the precharge control signal in synchronization with the clock signal, the delays produced by the delay circuits can be controlled according to the clock signal.

The image display device of the present invention is further arranged so that further provided is an operation period control section for outputting a signal for controlling a period of a switching operation by the reference signal switching section for start or stop of precharge of each data signal line with the precharge reference potential, and that the switching operation period for the start of precharge to the precharge reference potential is set longer. This causes the times when charges are transferred to the data signal lines from portions having the precharge reference potential to be further dispersed, and fluctuation of the precharge reference potential is further suppressed.

Furthermore, the image display device of the present invention is arranged so that further provided is a switching control section for outputting a signal for controlling the reference signal switching sections in accordance with outputs of the signal delay sections and a charge end signal for stopping charging of each data signal line to the precharge reference potential, and that all the reference signal switching sections in the precharge circuit may simultaneously stop outputting of the precharge reference potential to each data signal line in response to the signal outputted by the switching control section. This enables to avoid fluctuation of the precharge reference potential caused by charges drawn therein upon a start of another sampling operation following to an end of a sampling operation applied to a certain data signal line. As a result, each data signal line is charged so as to have a desired potential.

Furthermore, by inputting the charge end signal before the data signal line driving circuit carries out an image data sampling operation to the data signal lines, precharge can be surely stopped. Therefore, it is possible to display excellent images without obstructing the image data sampling operation of the data signal line driving circuit.

The image display device of the present invention is further arranged so as to include a switching control section which uses the precharge control signal as the charge end signal fed to the switching control section so as not to require one more new signal, and which controls the reference signal switching section in accordance with the outputs of the signal delay sections and the precharge control signal, so that all the reference signal switching sections in the precharge circuit simultaneously stop outputting of the precharge reference potential to each data signal line. This makes it possible to avoid fluctuation of the precharge reference potential caused by charges drawn therein upon a start of another sampling operation following to an end of a sampling operation applied to a certain data signal line. As a result, each data signal line is charged so as to have a desired potential.

The image display device of the present invention is further arranged so that at least one of the precharge circuit, the data signal line driving circuit, and the scanning signal line driving circuit is provided on the same substrate that the pixels are provided on. With this arrangement, costs for manufacture and mounting of the driving circuit can be reduced, while reliability is effectively improved.

Furthermore, the image display device of the present invention is further arranged so that switching elements composing the precharge circuit, the data signal line driving circuit, the scanning signal line driving circuit, and the pixels are polycrystalline silicon thin film transistors. This allows the degree of movability to drastically increase (by several tens to several hundreds times) as compared with that of the amorphus silicon thin film transistor.

Furthermore, by forming the pixel-use switching elements with polycrystalline silicon thin film transistors, data are sufficiently written in even the last data signal line during one horizontal period, even in the case where, for example, the dot sequential driving method is applied. As a result, high-grade display can be achieved.

The image display device of the present invention is further arranged so that the switching elements are formed through a process in which temperature substantially does not exceed 600° C. This allows use of a glass substrate with a low deformation point that is inexpensive and capable of being formed larger. Therefore, in addition to the foregoing effects, the following effect can be achieved. Namely, a large image display device can be manufactured at low costs.

In the precharge circuit for charging the data signal lines before image signals are sequentially supplied to the data signal lines from the data signal line driving circuit, peak current during operations is suppressed, and variation of the potential of the reference signal written into the data signal lines so as to precharge the same is suppressed as well. As a result high-grade display can be achieved.

As described above, the present invention is intended to provide a logical circuit enabling reduction of power consumption, as well as an image display device in which the logical circuit is applied.

With the image display device of the present invention, a precharge circuit can be arranged so as to normally operate also in the case where a precharge control signal with a smaller amplitude than that of a driving voltage for the circuit is inputted, and a peak value can be lowered by dispersing current flowing through the precharge circuit (the precharge reference potential and the precharge control signal) in terms of time, that is, by causing the current to flow at different timings.

Accordingly, fluctuation of the precharge reference potential can be suppressed, thereby resulting in that precharge is sufficiently executed and the display quality is enhanced. Besides, since the current supply from outside that is necessary for precharge can be reduced or omitted, an effect of drastic reduction of power consumption can be achieved.

Furthermore, since the image display device of the present invention does not require a large buffer circuit, the following effect can be achieved. Namely, a space occupied by the circuit in the image display device can be reduced, and reliability of the circuit is enhanced.

As described above, the present invention is to realize low power consumption of an image display device, and produces a great effect in enhancing the performance of, and increasing additional value of, an image display device indispensable in the future information-oriented society, particularly a driving circuit-integrated liquid crystal display device and a portable equipment incorporating such a liquid crystal display device.

The invention being thus described, however, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image display device having a plurality of pixels in matrix that are defined by a plurality of data signal lines and a plurality of scanning signal lines intersecting with said plurality of data singal lines, a data signal line driving circuit for feeding image signals to the data signal lines, and a scanning signal line driving circuit for feeding a scanning signal to the scanning signal lines, said image display device comprising a precharge circuit, wherein said precharge circuit includes:

a reference signal input section, to which at least one precharge reference potential is inputted;

a control signal input section, to which at least one control signal is inputted;

a plurality of signal delay sections for sequentially delaying an output of said control signal input section; and a reference signal switching section for switching, in accordance with outputs of said signal delay sections, between a state of outputting the precharge reference potential of said reference signal input section to each of said data signal lines and a state of non-outputting the same thereto;

wherein said signal delay sections delay the output of said control signal input section, to vary timings of write of the precharge reference potential into said data signal lines, so that at least two different timings are available;

said precharge circuit includes a signal switching control section for outputting a signal for controlling said reference signal switching sections in accordance with outputs of said signal delay sections and a charge end signal for stopping charging of each data signal lie to the precharge reference potential; and all said reference signal switching sections in said precharge circuit simultaneously stop outputting of the precharge reference potential to each data signal line in response to the signal outputted by said switching control section.

2. The image display device as set forth in claim 1, wherein:

the at least one control signal is supplied to each of a plurality of said control signal input sections; and an output of each control signal input section is fed to said signal delay sections connected with said control signal input section.

3. The image display device as set forth in claim 1, wherein said control signal input section is provided on each of ends on both sides of said precharge circuit, and a signal is fed from each control signal input section to said signal delay sections.

4. The image display device as set forth in claim 1, wherein timings of signal input to said reference signal switching section are delayed by said signal delay sections so that timings at which the precharge reference potential is inputted to said data signal lines are sequentially delayed from ends on both sides of a display screen to center thereof.

5. The image display device as set forth in claim 1, wherein said control signal input section is disposed in a vicinity of center of said precharge circuit, and a signal is fed from said control signal input section to said signal delay sections.

6. An image display device having a plurality of pixels in matrix that are defined by a plurality of data signal lines and a plurality of scanning signal lines intersecting with said plurality of data singal lines, a data signal line driving circuit for feeding image signals to the data signal lines, and a scanning signal line driving circuit for feeding a scanning signal to the scanning signal lines, said image display device comprising a precharge circuit, wherein said precharge circuit includes:

a reference signal input section, to which at least one precharge reference potential is inputted;

a control signal input section, to which at least one control signal is inputted;

a plurality of signal delay sections for sequentially delaying an output of said control signal input section; and a reference signal switching section for switching, in accordance with outputs of said signal delay sections, between a state of outputting the precharge reference potential of said reference signal input section to each of said data signal lines and a state of non-outputting the same thereto, wherein timings of signal input to said reference signal switching section are delayed by said signal delay sections so that timings at which the precharge reference potential is inputted to said data signal lines are sequentially delayed from center of a display screen to ends on both sides thereof.

7. The image display device as set forth in claim 1, wherein said control signal input section is connected with a plurality of said signal delay sections.

8. The image display device as set forth in claim 1, wherein each of said signal delay sections is connected with a plurality of switches composing said reference signal switching section.

9. The image display device as set forth in claim 1, further comprising an amplitude amplifying section functioning to amplify the control signal, at a stage subsequent to said control signal input section.

10. The image display device as set forth in claim 1, wherein each of said signal delay sections delays the control signal, as well as amplifies the control signal.

11. The image display device as set forth in claim 1, wherein each of said signal delay sections includes a CMOS inverter circuit, at least one of channel widths and channel lengths of a p-channel transistor and an n-channel transistor of said CMOS inverter circuit being variable.

12. The image display device as set forth in claim 1, wherein each of said signal delay sections includes a CMOS inverter circuit, and delay periods produced by said signal delay sections are adjusted by arranging each CMOS inverter circuit so that at least one of channel widths and channel lengths of a p-channel transistor and an n-channel transistor thereof is variable.

13. The image display device as set forth in claim 1, wherein said signal delay sections include CMOS inverter circuits, said CMOS inverter circuits being arranged so that at least one of channel widths and channel lengths of a p-channel transistor and an n-channel transistor composing one of said CMOS inverter circuits differs from that of another one of said CMOS inverter circuits.

14. The image display device as set forth in claim 1, wherein:

each signal delay section delays the at least one control signal, includes a CMOS inverter circuit, and amplifies the at least one control signal; and delay periods produced by said signal delay sections and amplification of the control signal are adjusted by arranging each CMOS inverter circuit so that at least one of channel widths and channel lengths of a p-channel transistor and an n-channel transistor thereof is variable.

15. The image display device as set forth in claim 1, wherein each of said signal delay section includes at least one of a wire capacitor and a wire resistor of a control signal line.

16. The image display device as set forth in claim 1, wherein each of said signal delay section includes at least one of a wire capacitor, a wire resistor of a control signal line, and a CMOS inverter circuit.

17. The image display device as set forth in claim 1, wherein each of said signal delay section includes a flip-flop circuit.

18. The image display device as set forth in claim 1, wherein said precharge circuit includes an operation period control section for outputting a signal for controlling a period of a switching operation by the reference signal switching section for start or stop of precharge of each data signal line with the signal fed from said reference signal input section.

19. The image display section as set forth in claim 1, wherein the control signal is used as the charge end signal to be fed to said switching control section.

20. The image display device as set forth in claim 1, wherein said precharge circuit includes a switching control section for supplying each reference signal switching section with:

a charge start signal for starting charging of each data signal line to the precharge reference potential, according to the output of said control signal input section and the output of said signal delay section having a function to input the precharge reference potential to said switching control section; and a charge end signal for stopping charging of each data signal line to the precharge reference potential, according to the output of said control signal input section.

21. The image display device as set forth in claim 20, wherein said switching control section supplies each reference signal switching section with:

the charge start signal, when the output of said control signal input section and the output of said signal delay section having a function to input the precharge reference potential to said switching control section are at respective predetermined levels; and the charge end signal, when the output of said control signal input section is not at the predetermined level.

22. The image display device as set forth in claim 1, wherein at least one of said precharge circuit, said data signal line driving circuit, and said scanning signal line driving circuit are provided on a same substrate that said pixels are provided on.

23. The image display device as set forth in claim 1, wherein active elements composing said precharge circuit, said data signal line driving circuit, said scanning signal line driving circuit, and said pixels are polycrystalline silicon thin film transistors.

24. The image display device as set forth in claim 23, wherein said active elements are formed through a process in which temperature substantially does not exceed 600° C.

25. The image display device as set forth in claim 1, wherein the timings are different regarding all said data signal lines, so that any one of the timings is different from any other of the same.

26. The image display device as set forth in claim 1, wherein the signal of said reference signal input section is fed from each of said reference signal switching sections to corresponding one of said data signal lines, respectively.

27. The image display device as set forth in claim 1, wherein said precharge circuit writes the precharge reference potential to each data signal line before image signals are written into said data signal lines.

28. The image display device as set forth in claim 27, wherein said precharge circuit writes the precharge reference potential in each data signal line during a flyback period.

29. An image display method, for displaying an image on an image display device with a plurality of pixels in matrix that are defined by a plurality of data signal lines, to which image signals are fed, and by a plurality of scanning signal lines intersecting with said plurality of data singal lines, to which a scanning signal is fed, said image display method having the step of writing the image signals to the data signal lines after writing a precharge reference potential from a precharge circuit into each of the data signal lines, wherein:

timings of write of the percharge reference potential fed from the precharge circuit into the data signal lines are varied so that at least two timings are available; and outputting of the precharge reference potential to each data signal line is simultaneously stopped.

30. The image display method as set forth in claim 29, wherein the timings are made different regarding all said data signal lines, so that any one of the timings is different from any other of the same.

* * * * *

UNITED STATES PATENT AND TRADEMARK OFFICE

CERTIFICATE OF CORRECTION

PATENT NO. : 6,618,043 B2
DATED : September 9, 2003
INVENTOR(S) : Hajime Washio et al.

It is certified that error appears in the above-identified patent and that said Letters Patent is hereby corrected as shown below:

Title page,
Item [56], U.S. PATENT DOCUMENTS please insert: --

-- FOREIGN PATENT DOCUMENTS

JP 7-295521 (11/10/95)
JP 10 - 105126 (4/24/98) --

Signed and Sealed this

Eleventh Day of May, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,618,043 B2
DATED : September 9, 2003
INVENTOR(S) : Hajime Washio et al.

It is certified that error appears in the above-identified patent and that said Letters Patent is hereby corrected as shown below:

Column 17,
Line 16, please delete “singal” and insert -- signal --

Column 18,
Line 11, please delete “singal” and insert -- signal --

Column 20,
Line 37, please delete “singal” and insert -- signal --

Signed and Sealed this

Eighteenth Day of January, 2005

JON W. DUDAS
*Director of the United States Patent and Trademark Office*